US009895596B2

(12) United States Patent
Bogan

(10) Patent No.: US 9,895,596 B2
(45) Date of Patent: Feb. 20, 2018

(54) RELEASABLE BINDING SYSTEM

(71) Applicant: Nathaniel Bogan, Natick, MA (US)

(72) Inventor: Nathaniel Bogan, Natick, MA (US)

( * ) Notice: Subject to any disclaimer, the term of this patent is extended or adjusted under 35 U.S.C. 154(b) by 0 days.

(21) Appl. No.: 15/440,276

(22) Filed: Feb. 23, 2017

(65) Prior Publication Data

US 2017/0239554 A1 Aug. 24, 2017

Related U.S. Application Data

(60) Provisional application No. 62/299,251, filed on Feb. 24, 2016, provisional application No. 62/364,534, filed on Jul. 20, 2016.

(51) Int. Cl.
*A63C 9/085* (2012.01)
*A63C 10/12* (2012.01)

(52) U.S. Cl.
CPC ..... *A63C 9/08564* (2013.01); *A63C 10/12* (2013.01)

(58) Field of Classification Search
CPC ..... A63C 9/00; A63C 9/081; A63C 9/08514
See application file for complete search history.

(56) References Cited

U.S. PATENT DOCUMENTS 5,947,488 A * 9/1999 Gorza ..... A63C 10/18 280/14.21
8,376,390 B2 * 2/2013 Neiley ..... A63C 10/18 280/14.21

* cited by examiner

*Primary Examiner* — John Walters
*Assistant Examiner* — James Triggs
(74) *Attorney, Agent, or Firm* — Gonzales Patent Services; Ellen Gonzales

(57) ABSTRACT

A mechanism for attaching, for example, a boot to a ski, that uses a sphere in cylinder geometry to enable release in a wide array of incremental directions and rotations.

20 Claims, 23 Drawing Sheets

RELEASABLE BINDING SYSTEM

CROSS-REFERENCE TO RELATED APPLICATIONS

The following application claims benefit of U.S. Provisional Application Nos. 62/299,251, filed Feb. 24, 2016 and 62/364,534, filed Jul. 20, 2016, each of which is hereby incorporated by reference in its entirety.

BACKGROUND

A number of sports or recreational activities require the attachment of a user's body part (frequently a foot) to a piece of equipment via a binding in order to allow the user to control the equipment. For example, snow skiing, snowboarding, waterskiing, wakeboarding, and the like all generally employ a binding that attaches a skier's foot (or shoe/boot) to a board or ski. However, unlike many other attachment mechanisms that are designed to detach (or release) only in response to one or more specific user inputs (pressing a button, moving the object in a certain way, etc.), ski bindings typically are designed to release in response to an external stressor e.g., in the event of a fall so as to avoid or reduce significant injury. However, mechanisms to facilitate this "stress-based" release, can be challenging to design, as the force and stresses placed on the binding during normal use can be quite significant and an unexpected/undesired release during normal activity can also result in significant injury. Because stress-based releases typically come from unexpected and unpredictable angles, it is almost always desirable for the binding system to enable release in virtually any direction. Moreover, different users with different skill sets, levels of experience, or desired activities may have significantly different desired tolerance levels for the factors such as the force or torque that are required to trigger a stress-based release. (Consider for example, the varied release tolerances of a beginning or recreational water-skier, a beginning or recreational snow skier/boarder, a professional slalom skier (water or snow), a downhill racer, a mogul skier, or an aerialist.) Furthermore, for obvious reasons that tend to be consistent across a variety of sports equipment, is it generally desirable for the binding to be lightweight and have a low or small profile on the ski. However most current binding systems suffer from some combination of: limited degrees of freedom of releasability, excess weight, or contact distance between boot and ski. Accordingly, there is a need for a binding system that addresses each of these concerns.

Accordingly, there is a great need for lightweight, low profile bindings that have easily adjustable tolerances and which enable release in virtually any number of incremental rotations and directions.

SUMMARY

The present disclosure provides a mechanism for releasably attaching a first object to a second object. According to various embodiments, the attachment mechanism enables release in a wide array of incremental directions and rotations. Moreover, various embodiments provide an attachment mechanism which enables the user to select a release threshold wherein only a force or torque applied above this threshold results in release. The mechanism may also include a user-operated release mechanism that may or may not be subject to the threshold force or torque requirements. As a specific example, the mechanism may be employed in a binding system that releasably attaches a boot or other wearable article to a ski or other piece of sports equipment.

DETAILED DESCRIPTION

Figure 1:
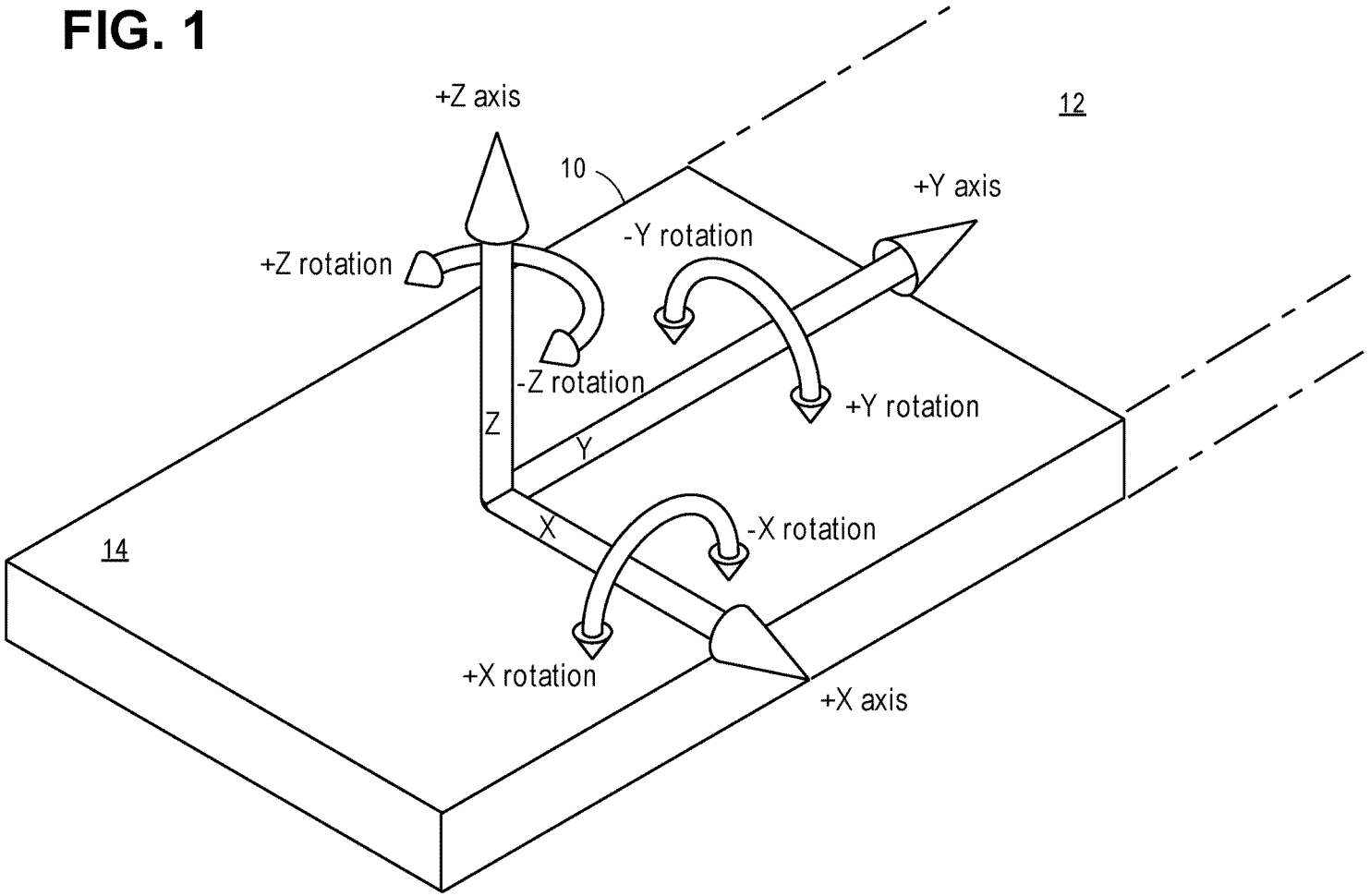
FIG. 1 is a schematic illustration of the various rotational and translational directions discussed in the present disclosure.

In general, the present disclosure provides a mechanism for releasably attaching a first object to a second object. According to various embodiments, the attachment mechanism enables release in a wide array of incremental directions and rotations. Moreover, various embodiments provide an attachment mechanism which enables the user to select a release threshold wherein only a force or torque applied above this threshold results in release. Of course, the mechanism may also include a user-operated release mechanism that may or may not be subject to the threshold force or torque requirements.

As a specific example, the mechanism may be employed in a binding system that releasably attaches a boot or other wearable article to a ski or other piece of sports equipment. Of course, it will be understood that while many of the specific examples are directed towards a boot/ski binding system, the mechanism itself may be applicable to a wide variety of applications wherein it is desirable for a second object to be able to release in a variety of rotational directions from a first object only after application of a pre-determined, and perhaps user-defined amount of force. While perhaps most easily understood in the context of ski bindings, such applications are not necessarily limited to sports equipment, but may include for example, prosthetics, safety riggings, and other applications where there is a desire for a range of release direction options and a preferred failure point.

According to some embodiments the binding described herein may attach a wearable object to another object. For the purposes of the present disclosure a wearable object may be any object which is normally worn, mounted, or otherwise attached to a body (including both humans and animals) including, for example, without limitations, shoes, boots, helmets, harnesses, saddles, wrappings, etc. Because the present mechanism can perhaps most easily be understood in the context of skiing, the present disclosure, for the purposes of simplicity will refer to a "binding" that attaches a "skier's" "boot" to a "ski." However, it should be understood that the disclosure and invention should not be considered to be limited to only those objects. Accordingly, the as described attachment system can easily be used to attach any first object to any second object. Moreover, it will be understood that the user may not necessarily be engaged in the act of skiing and thus may not actually be a "skier."

Because the present disclosure relies heavily on an understanding of how and when the binding releases as well as a unique sphere in cylinder design, understanding of the invention will be greatly enhanced by a general discussion of the nomenclature that is used herein to describe directions of translation and incremental rotations. There are three orthogonal directions (in three dimensions) and we name them relative to the ski as follows:

X: The positive X direction points toward the skier's right, when the skier is facing the tip of the ski.

Y: The positive Y direction points toward the ski's tip.

Z: The positive Z direction points upward, normal to the plane of the ski.

There are also three orthogonal rotations in three dimensions, and there are many ways to characterize them, including the order in which they are applied or, equivalently, whether the rotation planes are attached to the world or the body. However, for this context we do not need that level of exactness, and we just need to name the rotations for reference.

In addition, the present disclosure refers to "incremental rotations." In mathematics, this is called a Lie Algebra, and in three dimensions there are six such rotations—in each rotation plane, we also differentiate by the direction of incremental rotation. We choose to name rotations according to the axis they rotate around, and use a right-handed nomenclature: if your right thumb is pointed down the axis, then your fingers curl in the direction of positive rotation. As a short-hand, we denote "positive-direction rotation around the X axis" as simply "+X rotation." Corresponding methodology is applied for the intended meanings of −X rotation, +Y rotation, −Y rotation, +Z rotation, and −Z rotation. FIG. 1 shows these coordinate axes and rotation nomenclature conventions visually. Specifically, a portion of ski/board 10 is shown having a tip (distal) end 12 and a rear 14. The X, Y, and Z axes are shown with labeled arrows, as are the corresponding positive and negative rotations around these axes.

Figure 2:
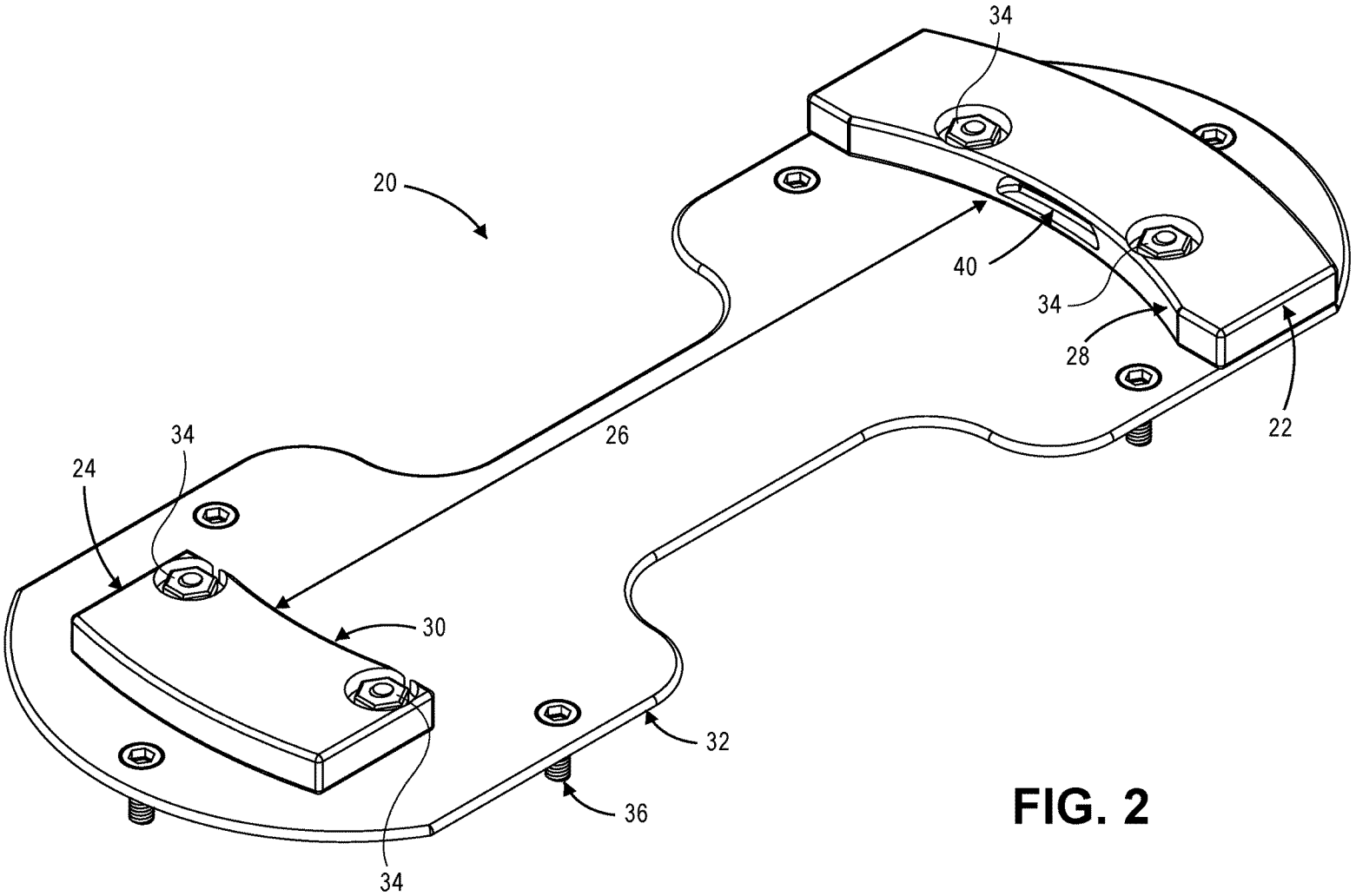
FIG. 2 is a schematic illustration of a mount according to an embodiment of the present disclosure.
Figure 3:
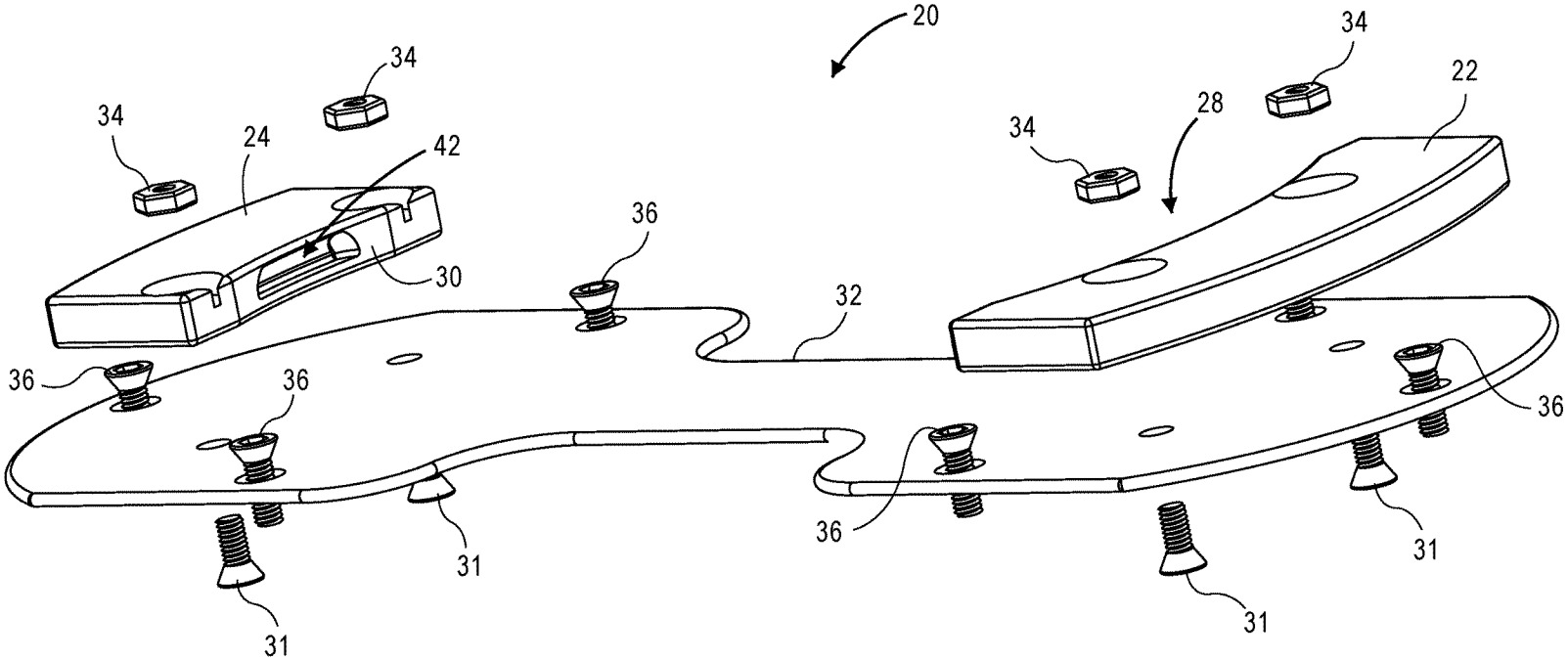
FIG. 3 is an exploded view of the mount in FIG. 2.

According to a first embodiment, the binding system disclosed herein is comprised of two components, a mount, which is affixed to or integrated with the ski and an insert which is affixed to or integrated with the boot. FIG. 2 is a schematic illustration of an exemplary embodiment of a mount 20 and FIG. 3 is an exploded view of the same mount taken from a second angle. Viewing FIGS. 2 and 3 together, it can be seen that mount 20 comprises first and second mount bodies: front mount body 22 and rear mount body 24. As depicted, mount bodies 22 and 24 are spaced apart from each and are positioned so as to define a space 26 between them. As shown, the facing sides of each mount body have a concave portion which defines, for each mount body, an engagement surface. In FIGS. 2 and 3, the engagement surface in mount body 22 is labeled 28 while the engagement surface in mount body 24 is labeled 30. Moreover, each mount body engagement surface includes a socket. Front socket 40 in mount body 22 is shown in FIG. 2, while rear socket 42 in mount body 24 is shown in FIG. 3.

As best seen in FIG. 3, the mount bodies 22 and 24 are secured to a mount plate 32 via upwardly directed bolts 31 and buried nuts 34. While it will be understood that any suitable securing mechanism could be employed, including alternate nut and bolt configurations, glue, interlocking components, snaplocks, etc., the depicted arrangement has the benefit of providing the mount bodies with a smooth upper surface. Since this surface will eventually be positioned under the skier's foot, a smooth surface is desirable both for function and comfort. Of course as stated above, other methods for securing the mount bodies to the mount plate may be used and such methods may or may not provide a smooth upper surface. Moreover, while each mount body is shown as being secured by two bolts, it should be understood that the number and specific placement of the bolts/securing method is not limited to the depicted arrangement.

Returning to simultaneous viewing of FIGS. 2 and 3, it can be see that in the depicted embodiment, mount plate 32 can be secured to a ski (not depicted) via bolts 36. Again, it will be understood that the number and specific placement of the bolts/securing method is not limited to the depicted arrangement. The mount plate enables the enforcement of a consistent spatial relationship between the mount bodies. This may be particularly desirable in embodiments wherein there is a high degree of expected flex in the ski during use. However, it will also be understood that rather than securing the mount bodies to a mount plate, as shown in the depicted embodiment, the mount bodies could be secured directly to the ski itself, eliminating the need for the mount plate. This may be advantageous when there is a strong desire to reduce weight and keep the binding closer to the ski.

Figure 5:
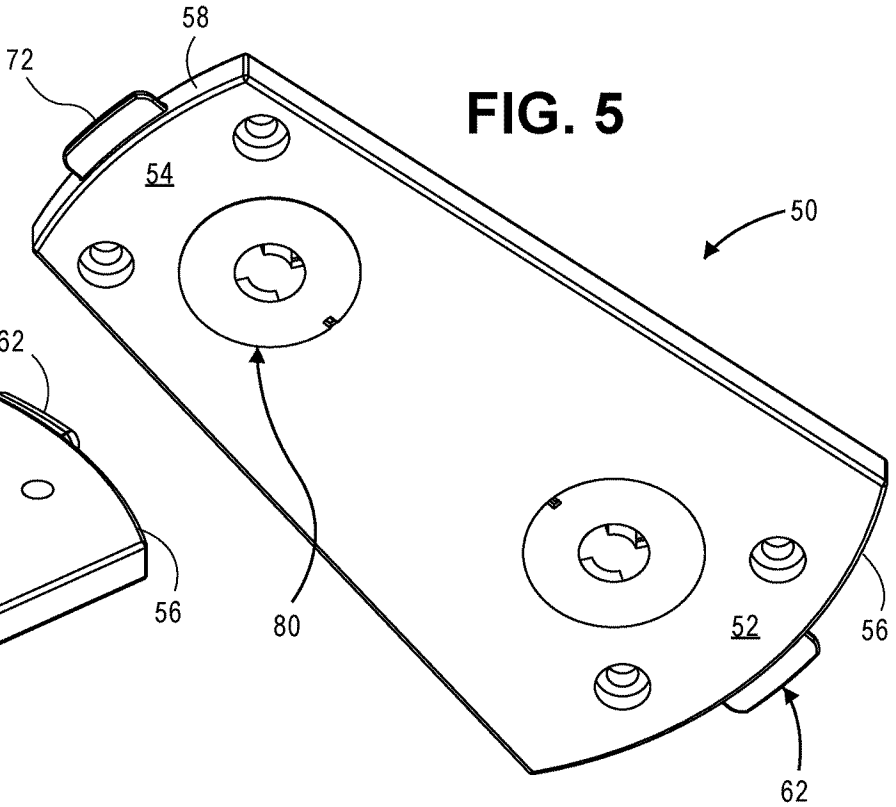
FIG. 5 is a schematic bottom-view of the insert of FIG. 4.
Figure 4:
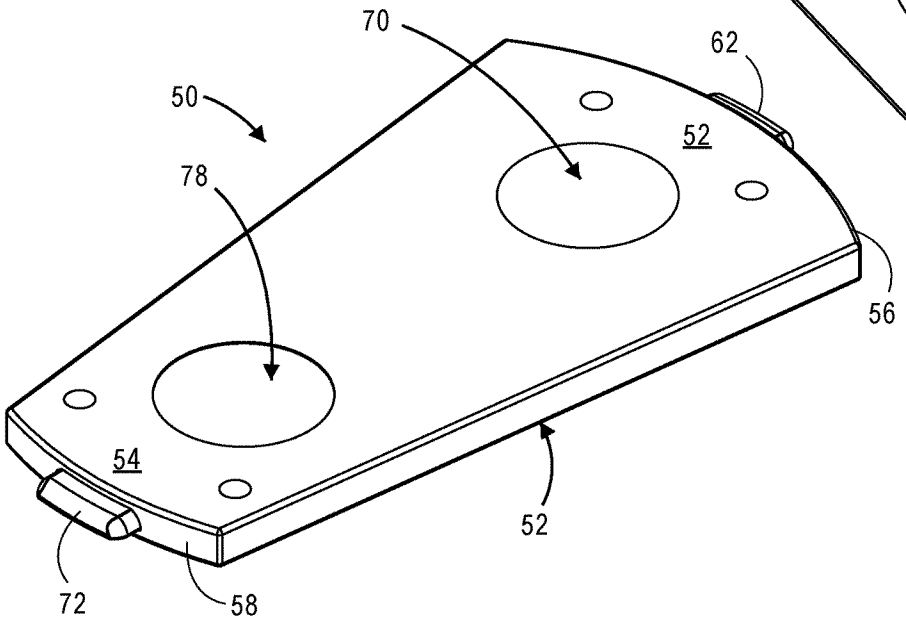
FIG. 4 is a schematic top-view of an insert suitable for use with the mount of FIG. 2.
Figure 6:
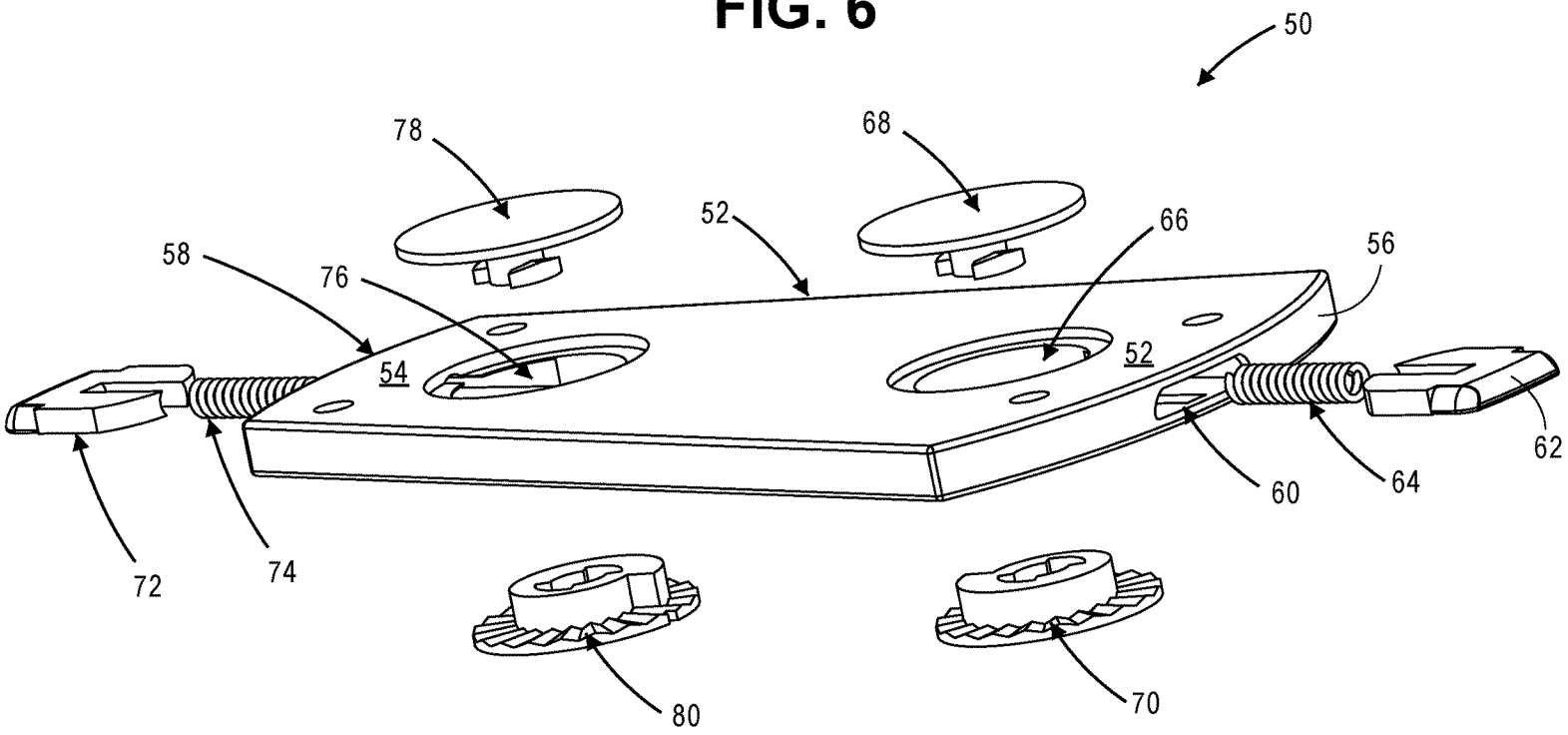
FIG. 6 is an exploded view of the insert of FIG. 4.

As stated above, the binding system comprises both the mount and an insert. FIG. 4 is a top view schematic illustration of an exemplary insert suitable for use with the mount shown in FIGS. 2 and 3. FIG. 5 is a bottom view schematic illustration of the insert of FIG. 4 while FIG. 6 is an exploded side view of the same. As shown, insert 50 includes an undersole 52 having a toe end 52 and a heel end 54. In the depicted embodiment, the toe end 52 is shown as being wider than the heel end, with the undersole body generally tapered from one end to the other. It should be understood, however, that other designs could be utilized including, but not limited to, designs which includes no taper at all (i.e. the toe and heel ends have the same width, one side being tapered to a greater degree than the other, and/or one side having a slight inward curvature or some other shape that may or may not mimic the general shape of a footprint. As depicted, each end 52, 54 is shown having a convex curvature which defines undersole engagement surfaces 56, and 58, respectively.

Directing attention towards the toe end half of the undersole, seated within and, under some conditions, extending out of, front pin channel 60 (shown only in FIG. 6) is a front pin 62. Also seated within front pin channel 60 is front tension spring 64 (also shown only in FIG. 6). Seated within front dial hole 66 (seen best in FIG. 6) is front dialmate 68 and front tension dial 70. Pin 62, front tension spring 64, front dialmate 68, and front tension dial 70 work in concert to produce a skier-operated front tension controlled release mechanism. For the purposes of the present disclosure, the term "pin" is not intended to imply or require any specific shape or size, but instead is used to refer to an extendable element of any shape or size which can be received by a socket and securely (and releasably) positioned within the socket via a tensioning mechanism.

In the depicted embodiment, a rear tension controlled release mechanism includes the same elements at the heel end of the undersole. Namely, a rear pin 72 sits within and, under some conditions, extends out of a rear pin channel (not shown). A rear tension spring 74 is seated within the rear pin channel. Seated within rear dial hole 76 is rear dialmate 78 and rear tension dial 80.

Whether in the front or rear of the binding, the tension controlled release mechanisms operate in substantially the same way. That is, the tension spring is operably connected to the dialmate and tension dial, which acts as a cam, and rotation of the tension dial either slightly extends or compresses the spring so as to increase or decrease the force required to displace the pin within its corresponding socket, thus allowing the user to make the binding "tighter" or "looser" according to his or her desired setting. It should be noted that the depicted embodiment enables the user to independently set the binding 'tightness" at the toe and heel ends of the binding. Of course, those of skill in the art will understand that there is a wide variety of tension control mechanisms that could be used in the present mechanism and that such mechanisms may or may not be controlled using the cam/dial system depicted. In general, in embodiments which employ the pin in socket configuration described herein, the tension control mechanism should control the amount of force required to displace the pin within the socket.

Figure 8:
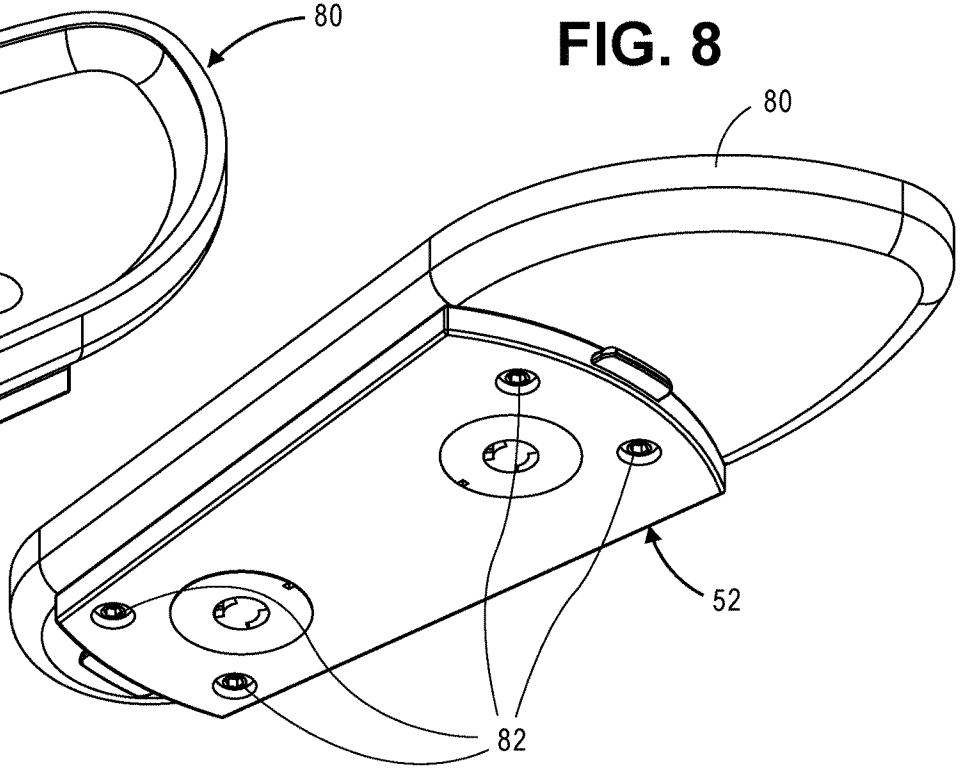
FIG. 8 is a bottom-view of the mounted insert of FIG. 7.
Figure 7:
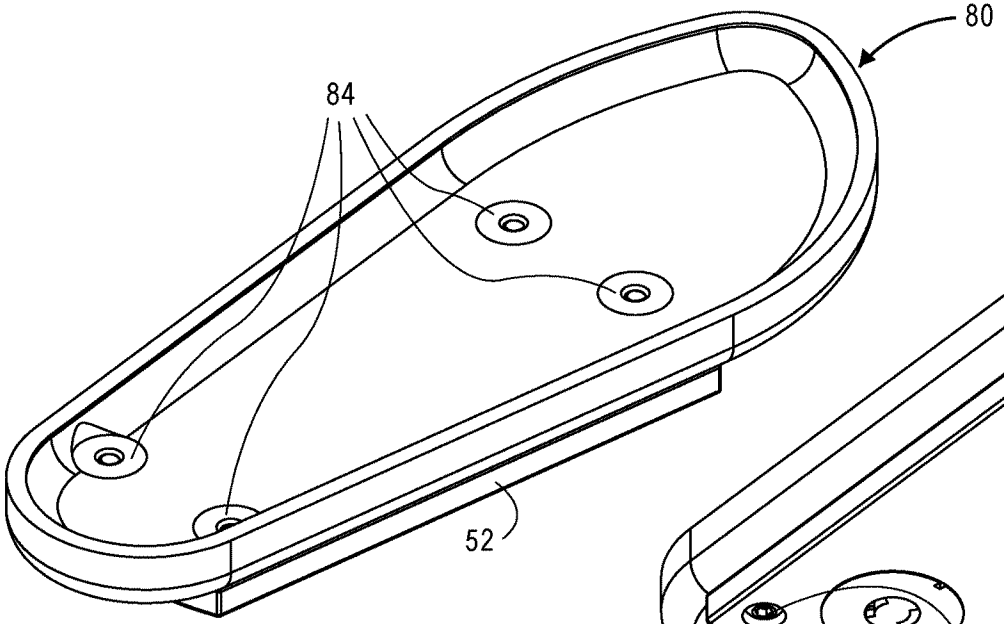
FIG. 7 is a top-view schematic illustration showing an insert mounted to the sole of a boot (shown in cutaway.)
Figure 9:
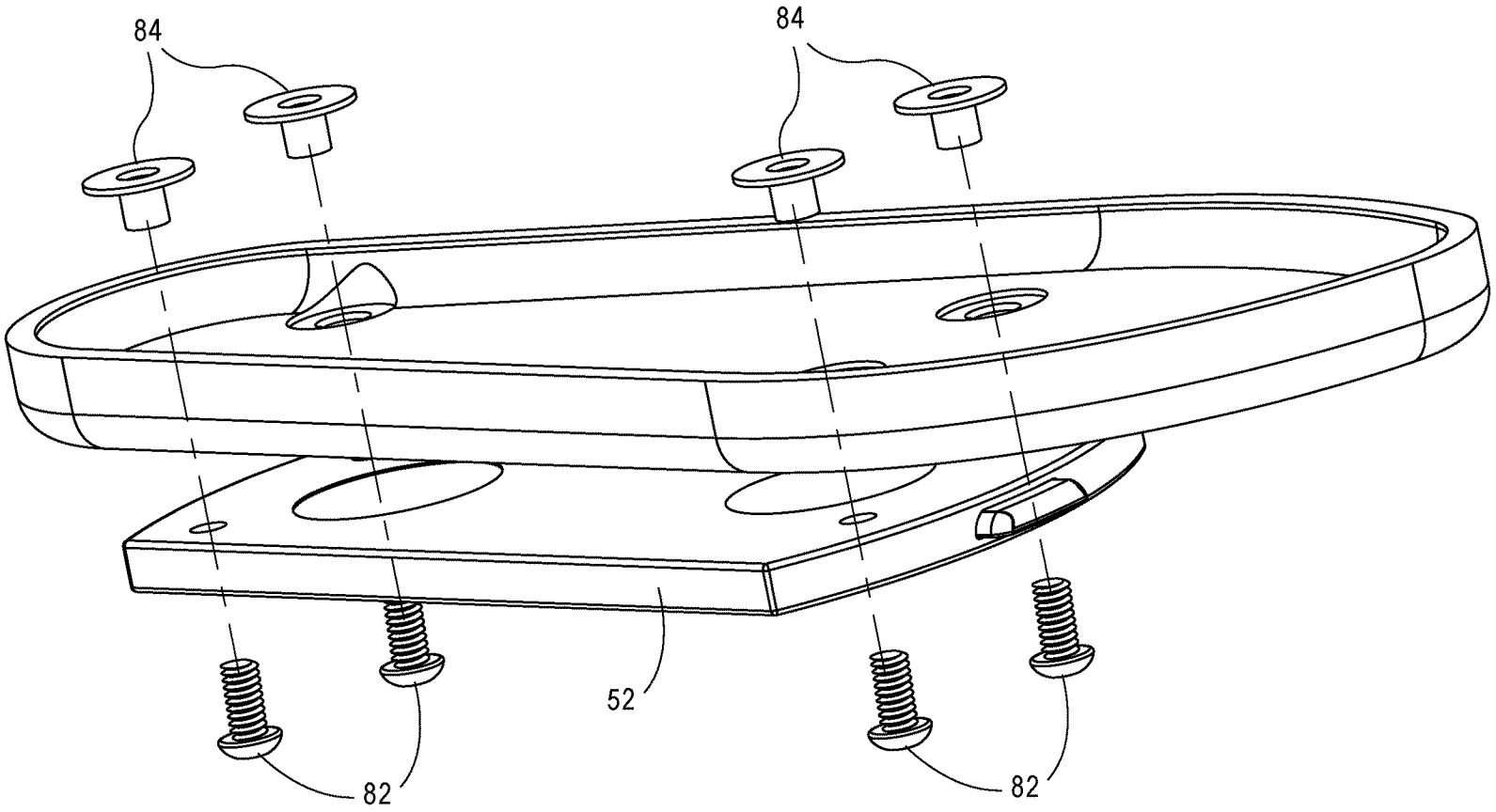
FIG. 9 is an exploded view of the mounted insert FIG. 7.
Figures 10, 11:
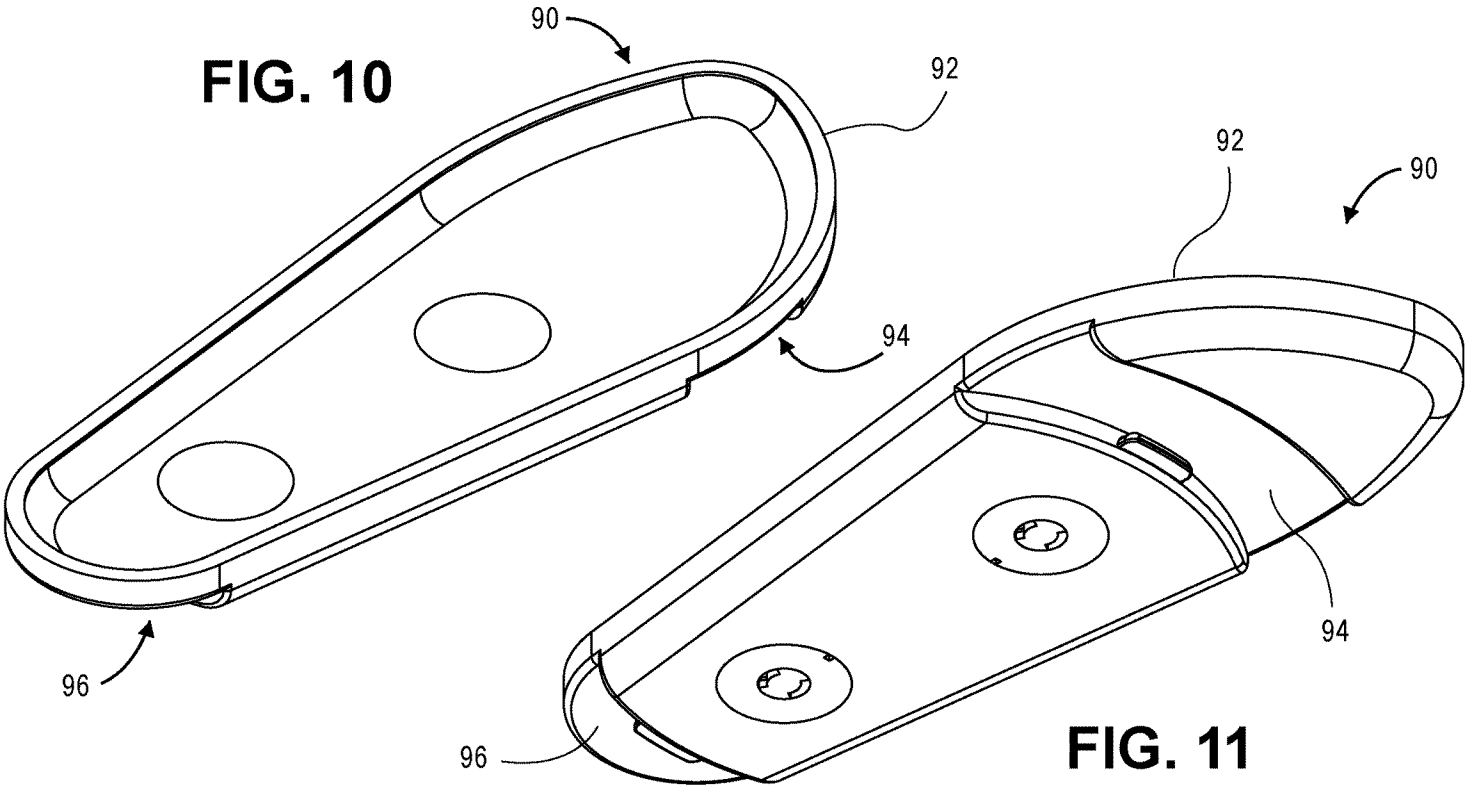
FIG. 10 is a top-view schematic illustration showing an insert integrated with the sole of a boot (shown in cutaway.)
FIG. 11 is a bottom-view of the integrated insert of FIG. 10.
Figure 12:
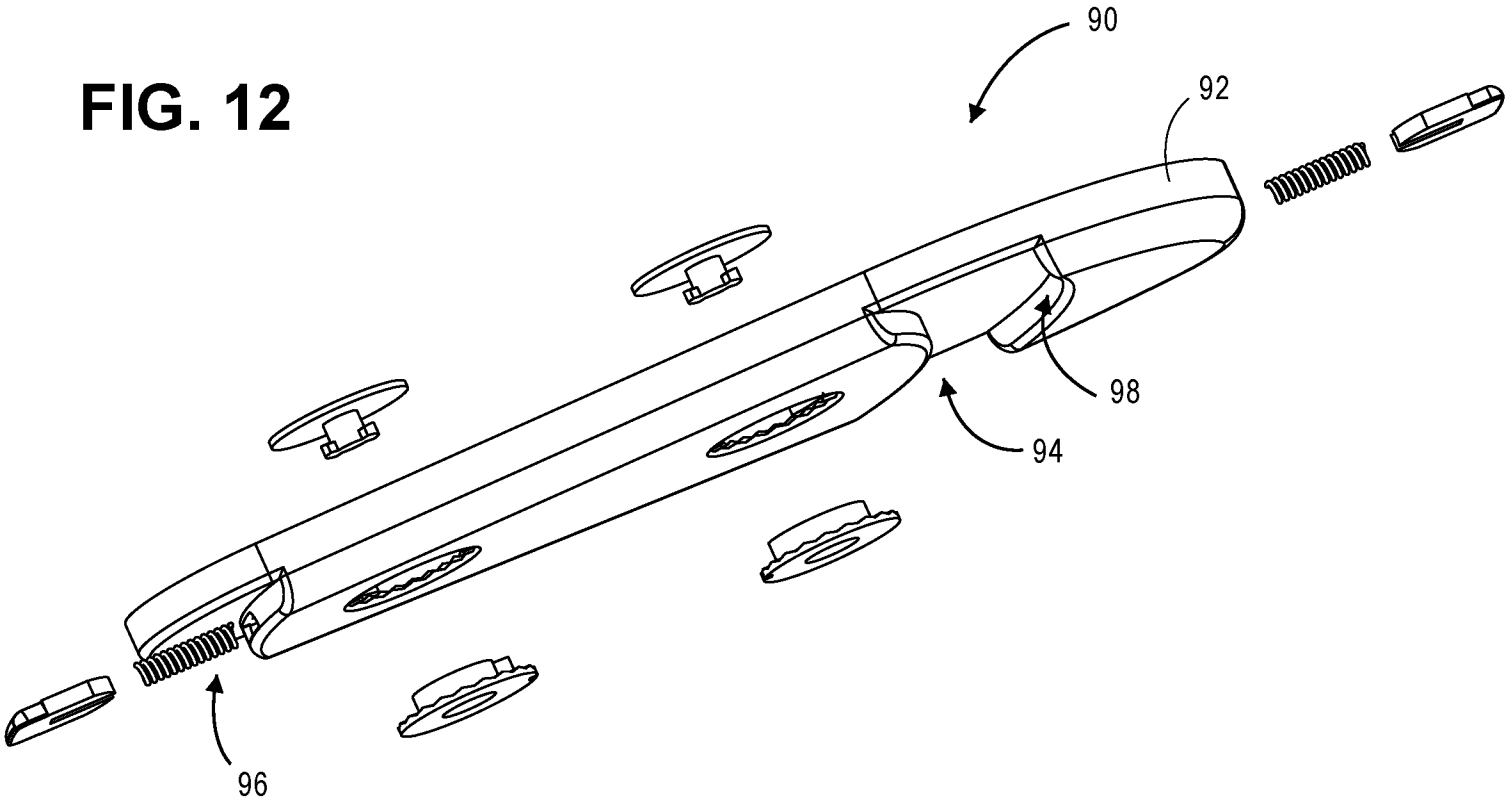
FIG. 12 is an exploded view of the integrated insert of FIG. 10.

According to some embodiments, the insert can be mounted to the bottom of a boot, as shown in FIGS. 7-9. In the depicted embodiment, the undersole 52 is secured to the bottom of the boot 80 (depicted in cutaway) via bolts 82 and nuts 84. FIG. 9 is an exploded view of the arrangement. Alternatively, as shown in FIGS. 10-12, a boot 90 could be manufactured with an integrated insert built as part of the sole. In this case, as shown best in FIG. 11, the underside of the boot's sole 92, includes a front Z channel 94 towards the toe end of the boot, which is sized and shaped to receive mount body 28 (not shown). Similarly, the underside of the boot's sole also includes a rear Z channel 96 towards the heel end of the boot, which is sized and shaped to receive mount body 30 (not shown). An exploded view of the integrated embodiment is shown in FIG. 12, which also shows the front and rear tension controlled release mechanisms described above.

Figure 37:
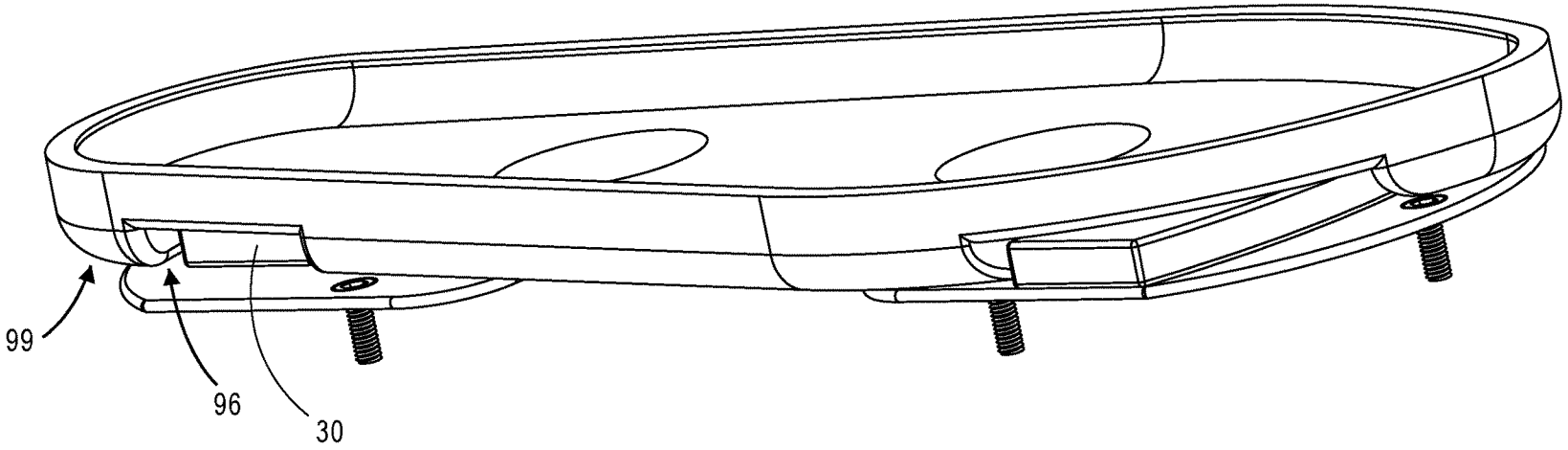
FIG. 37 is a schematic illustration of an alternative embodiment of an integrated boot/release mechanism wherein the heel end of the boot extends past the rear mount body.

FIG. 37 shows an alternative embodiment of an integrated boot/release mechanism wherein the heel end of the boot 99 extends past rear mount body 30, resulting in the presence of a full rear Z channel 96.

Figure 13:
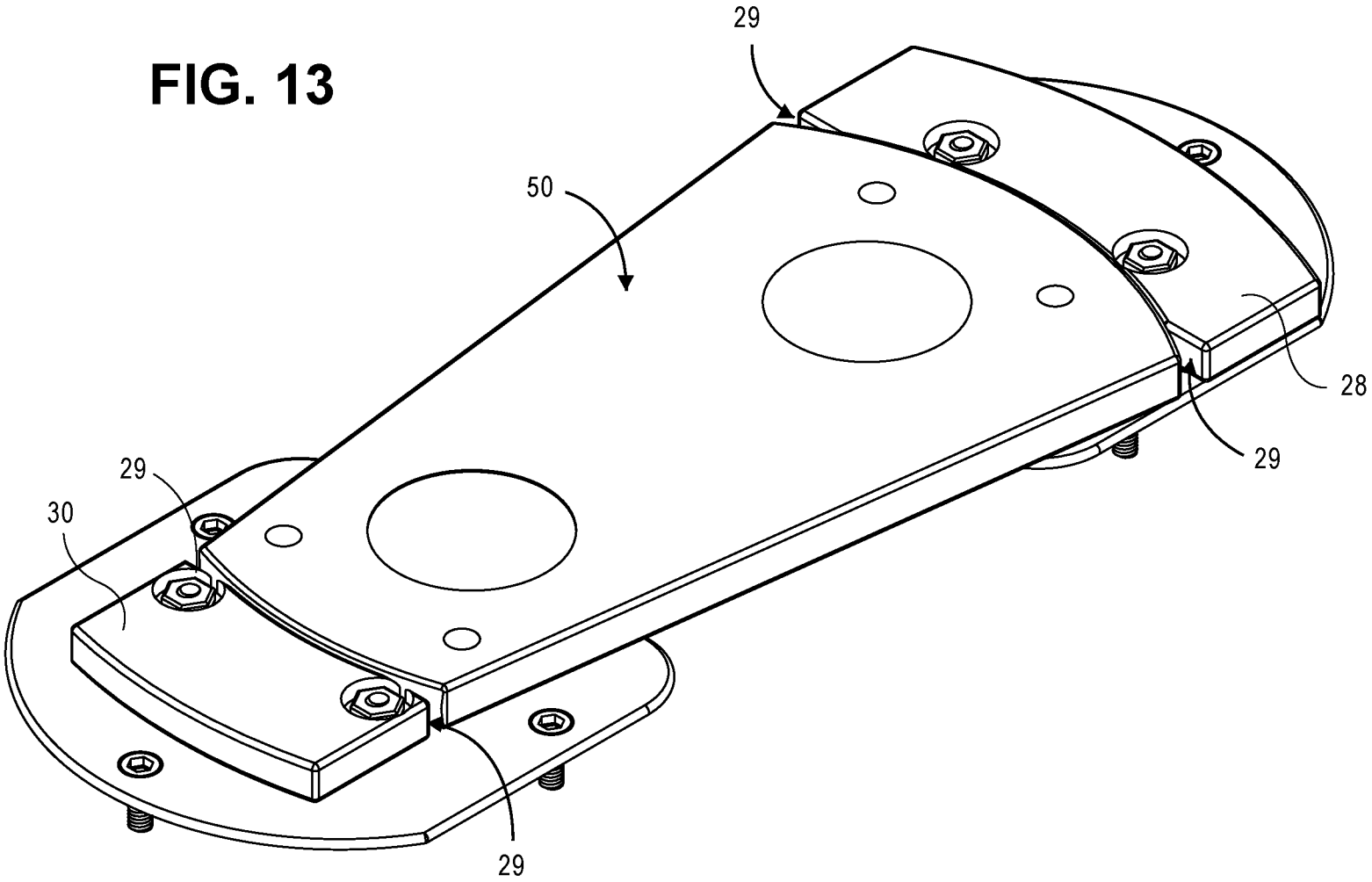
FIG. 13 is a schematic illustration of an insert nested within and thus secured to a mount.

FIG. 13 shows the insert 50 securely installed within the mount (variously and equivalently referred to herein as the various components being in a "locked," "secured," or "mounted" position). In this position the mount and insert act essentially as a single solid piece and enable the skier to translate his or her body movements through the boot and binding to the ski. While not shown in this drawing, it will be understood that in the locked position, the front and rear pins in the insert are in an extended position (i.e. pushed outwards via the springs) and are seated inside of the front and rear sockets in the mount bodies, respectively. It will, of course, be further understood that there will typically be at least some degree of force applied to the pin by the spring (or equivalent tensioning mechanism) when the pin is secured in its corresponding socket in order to maintain tension throughout the system and keep the mount and insert in the locked position. Though of course there may be some applications or some particularly loose binding settings where this is not desired and thus it should be understood that this is not necessarily a requirement of the presently described components and tensioning system. Additional details and embodiments are provided below in connection to several exemplary pin and socket geometries.

In order to discuss how the binding release mechanism operates, greater attention must first be paid to the above-mentioned concave and convex curvatures of the various engagement surfaces. As stated above, one desired attribute of ski bindings is the ability to release the boot from the ski in a variety of directions while still allowing the binding to be maintained under the skier's foot. Moreover, an ideal binding would allow for a release in any incremental rotation and any combination thereof. Accordingly, one embodiment of the present disclosure employs a "sphere inside a cylinder" configuration wherein the two mount bodies and the insert all share a radius. In the context of these nested components, it will be understood that the term "share a radius" should be interpreted as meaning that the components that "share a radius" have radial edges that enabling nesting of one component within the other. Accordingly, it will be understood that the actual radius of the component that is nested within the other component is marginally smaller. Moreover, it should also be understood that the phrase "share a radius" does not necessarily require the presence of physical structure for the entire circumference of the shared radius, as this would essentially require a circular insert surrounded entirely by a mount, but rather that where the components are adjacent to each other, at least a portion of the adjacent surfaces have nested radial edges, as shown in the embodiments in the various Figures. (Of course, while not depicted, an embodiment with a circular insert is possible and contemplated by the present disclosure.)

Figure 14:
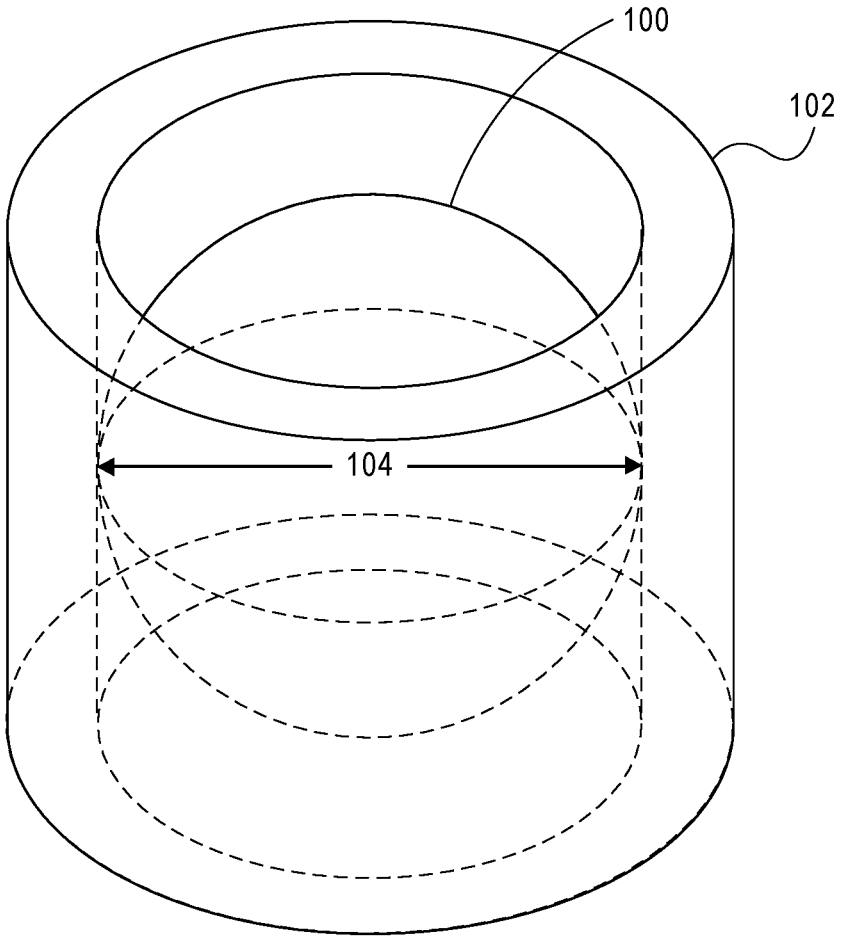
FIG. 14 demonstrates the sphere within a cylinder concept discussed in the present disclosure and illustrates how the mount and inserts described herein utilize the sphere within a cylinder concept.
Figure 16:
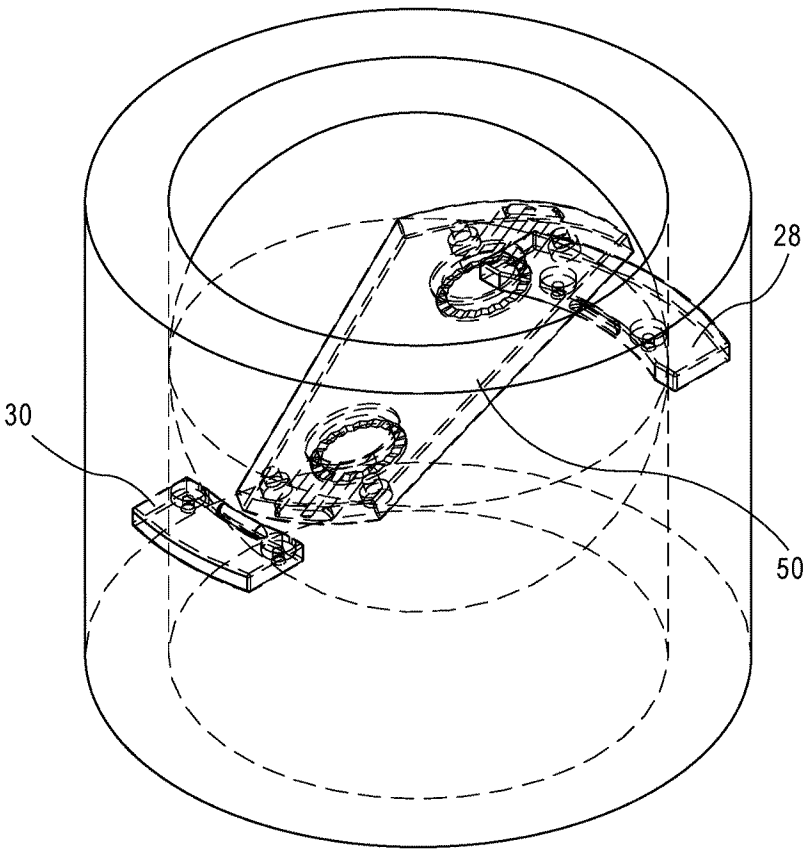
FIG. 16 shows an exemplary release within the sphere within a cylinder concept.
Figure 15:
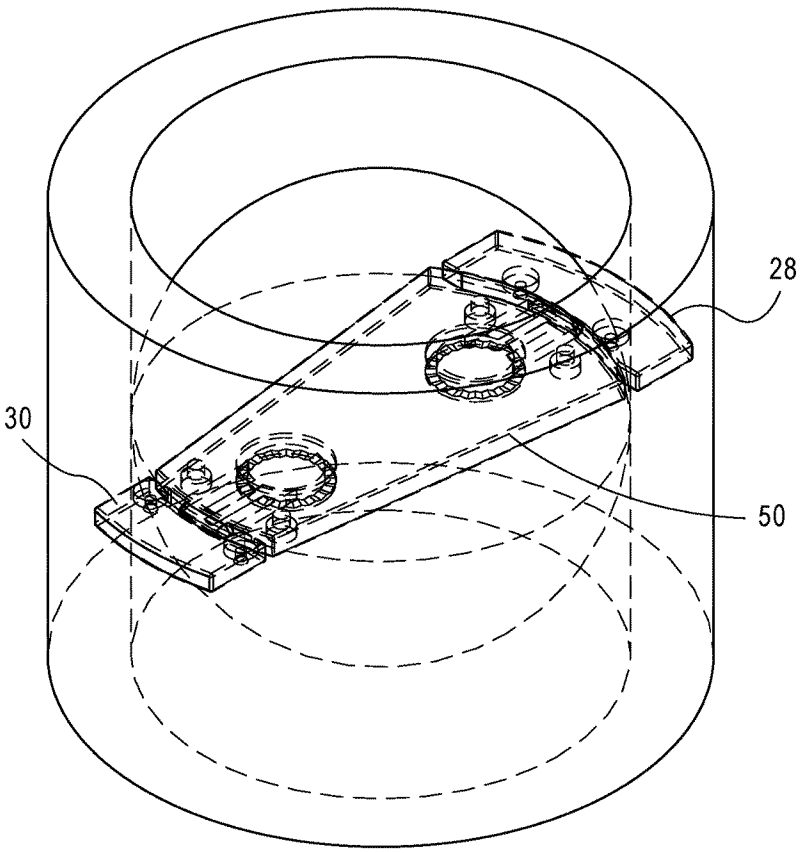
FIG. 15 shows an exemplary rotation within the sphere within a cylinder concept.

FIGS. 14-16 depict the geometry behind this configuration. In FIG. 14, sphere 100 sits inside of hollow cylinder 102, whose inner radius 104 matches that of the sphere. In the figure, the cylinder is oriented so that its axis is in the Z direction. Because of radial symmetry, the sphere can be rotated about its center in any possible way, while remaining wholly contained in the cylinder. Additionally, the sphere can translate along the axis of the cylinder. Accordingly, it can be seen that the sphere can do any combination of any rotation and any Z-direction translation while still contained in the cylinder.

Turning now to FIGS. 15 and 16, it can be seen that the curvatures (i.e. radial edges) of the engagement surfaces of mount bodies 28 and 30 and insert 50 represent a subset of the sphere inside the cylinder geometry such that the mount bodies are contained within the (same) hollow cylinder, and the insert is contained within the sphere. The sphere-in-cylinder analogy can be further extended when even more parts are nested, such as in the integrated-sole embodiment. In this embodiment, the outer edge of the inner component (e.g. the front of the front mount body) is considered to be part of a surface of the sphere, and the inner edge of the outer component (e.g. the front of the front Z channel (shown in FIG. 12 at 98) is considered to be part of a surface of the cylinder. FIG. 15 shows the components in the secured position, while FIG. 16 shows the components in the released position. From this depiction, it can be seen that release can occur in any rotation and or Z-translation. Of course, in practice, the lower half of all possible sphere-in-cylinder release geometries are blocked by the presence of the ski, i.e., the boot can only release in the northern "hemisphere," of the sphere-in-cylinder geometry, as other releases would necessitate the boot passing through the ski. For the purposes of the present disclosure the term "releasability hemisphere" encompasses all six incremental rotations and +Z translations shown in FIG. 1 or any combination thereof, while not including those rotations or translations that would require the boot (or a portion of the boot) to pass through the ski.

Further understanding of the release mechanism will now be aided by discussion of exemplary pin and socket geometries which facilitate operation of the herein described ski binding. For the purposes of discussion, the term "normal operation" is intended to mean those conditions when the skier wants the boot to remain attached to the ski—i.e. during normal skiing. The term "release event" is intended to mean those conditions during which a skier wants the boot to detach from the ski, for example at impact during a fall and thus an event which results in sufficient torque or force being placed on the binding to overcome the user-set tension setting which secures the boot to the ski. It will be understood of course, that different skiers will have different tolerances to conditions (a new skier may want the ski to release with nearly any type of torque or impact while a professional slalom skier would likely expect (and want) a substantial amount of torque to be placed on the skis during normal operation and thus would only want the ski to release in response to a high or very high degree of torque or force). Accordingly, the above-described tensioning system enables the individual skier to set the amount of force that is required to differentiate between what they would consider to be normal operations and a release event, and to change this setting as they see fit. Of course it will be understood that the present binding system could be provided with a single fixed tension setting (whether or not this fixed tension setting is initially dictated by the user) and that such embodiments are contemplated by the present disclosure.

According to various embodiments, when the binding is secured for normal operation, each pin is forced into a corresponding socket by a tensioner, such as a spring. Moreover, the pin, pin channel, and corresponding sockets are designed such that when in the locked position, a shear force, acting in any direction between the mount bodies and the sole, creates a force toward the center along the pin channel. Under normal operation, the force of the compressed spring is greater than the shear force, so the pin does not retract and the side walls of the socket prevent the pin from moving. However, when a translated shear force exceeds the force provided by the spring (for example due to impact during a fall), the pin begins to retract and/or move laterally within the socket. This lateral motion is translated to the insert, leading to release of the pin from the socket and a corresponding release of the insert from the mount bodies. (Of course it will be understood that the direction of shear force and corresponding pin movement and eventual release can occur within in any rotational or translational directions thus the reference to "lateral" movement is not limited to simply movement in the Z-plane, but includes any of the possible coordinates in the in the releasability hemisphere.)

Figure 17:
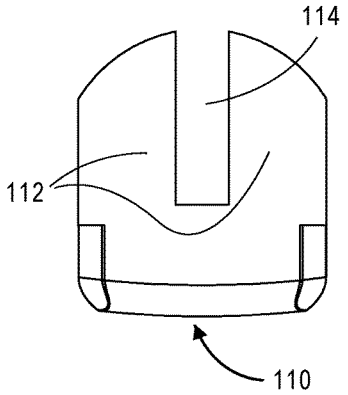
FIG. 17 is a top view of a first pin design according to the present disclosure.
Figure 18:
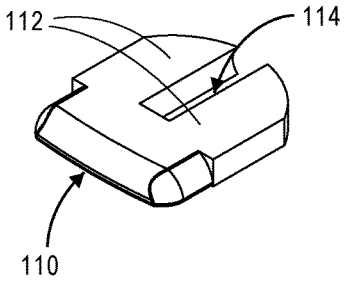
FIG. 18 is a three-dimensional view of the pin of FIG. 17.
Figure 19:
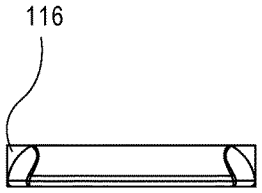
FIG. 19 is a front-end view of the pin of FIG. 17.
Figure 20:
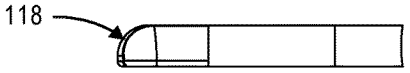
FIG. 20 is a side profile of the pin of FIG. 17.
Figure 21:
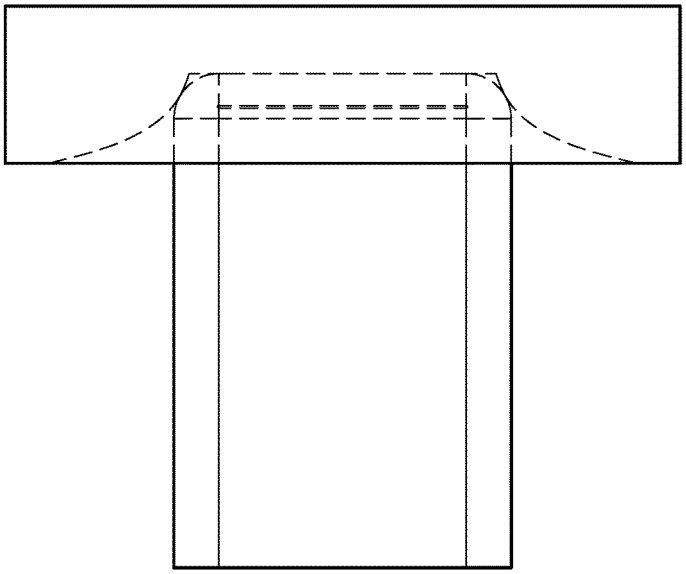
FIG. 21 is a schematic illustration of a pin locked within a vortex channel, according to an embodiment of the present disclosure.
Figure 22:
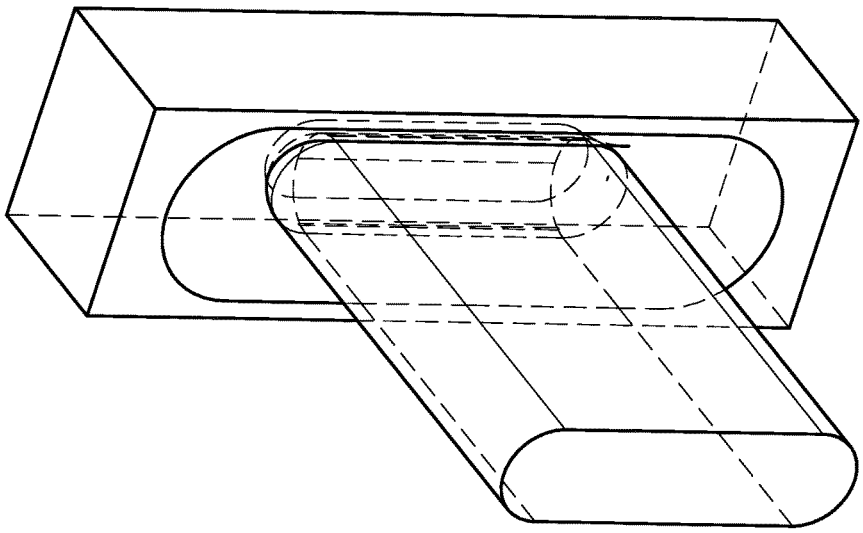
FIG. 22 is a three-dimensional illustration of the pin and vortex channel configuration shown in FIG. 21.

FIGS. 17-20 shown an example of a pin design wherein both the front edge and distal lateral surfaces of the pin head are rounded. Turning first to FIGS. 17 and 18, it can be seen that the distal end (or head) 110 of the pin is rounded both over the distal edge as well as along a portion of the lateral profile. In the depicted embodiment, the pin further includes fins 112, which help to maintain pin rigidity and channel 114, which is sized and shaped to receive the tension spring. FIG. 19 is a front end view of the pin in FIGS. 17 and 18. From this angle, it can be understood that the top profile 116 of the pin head helps Y-rotation releases to be smooth and the wide based helps keep a solid connection between the pin and the pin channel during normal operation. FIG. 20 is a side profile of the pin in FIGS. 17 and 18. From this view, it can be understood that the front profile 118 is rounded to assure that a relevant X-rotation will push the pin inwards against the force of the tension spring, enabling release.

Moreover, the depicted front profile design enables Y-rotations to lift one side of the pin, which also pushes the pin inwards against the force of the tension spring, again enabling release.

Figure 23A:
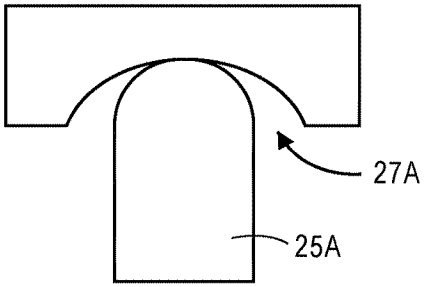
FIG. 23A is a schematic illustration of a traditional pin in channel configuration in the locked position.
Figure 24A:
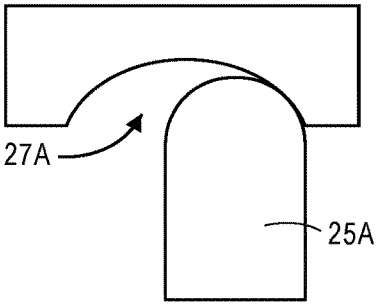
FIG. 24A shows the pin and channel geometry of FIG. 23A as the pin is releasing from the channel.

FIG. 23*a* is a schematic side illustration of a typical tensioned pin and socket geometry. In this configuration, a pin 25*a* with a rounded head is position with in a scoop-shaped socket 27*a*. The pin is held in place (with the tip against the deepest portion of the socket) via a spring or other tensioning mechanism as described above.) As explained above, when a translated shear force exceeds the force provided by the spring (for example due to impact during a fall), the pin begins to move within the socket, as shown in FIG. 24*a*. It should be noted that in this particular configuration, the steepest tangent angle of lateral contact surfaces between the pin and socket remains the same or increases as the pin moves within the pocket. This can, under certain circumstances actually increase the holding force as the pin is displaced.

However, according to some embodiments, it may be desirable to maximize the differential between the holding force under normal operation and holding force during a release event. Put another way, it may be desirable to ensure the binding is secure as possible (and thus won't release) during normal operation, but that release is as fast and easy as possible during a release event. Accordingly, in these embodiments, a pin and socket geometry that increases the holding force during displacement may be less desirable.

Accordingly, the present disclosure provides alternate channel geometries wherein the steepest tangent angle of lateral contact surfaces between the pin and socket occurs when the pin is in the locked position within the socket, and the tangent angle of contact surfaces decreases when/as the pin is displaced, ensuring that displacement of the pin does not increase and in some cases actually decreases, the holding force.

Figure 23B:
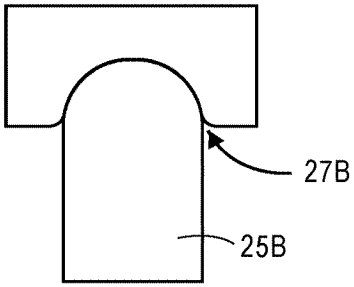
FIG. 23B is a schematic illustration of an alternative channel geometry according to an embodiment of the present disclosure showing the pin in the locked position.
Figure 23C:
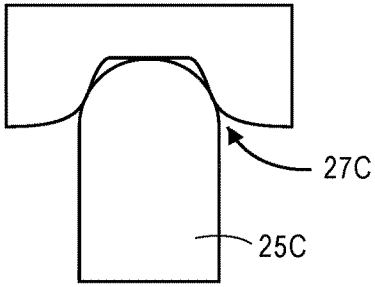
FIG. 23C is a schematic illustration of a vortex channel geometry according to yet another embodiment of the present disclosure showing the pin in the locked position.
Figure 24B:
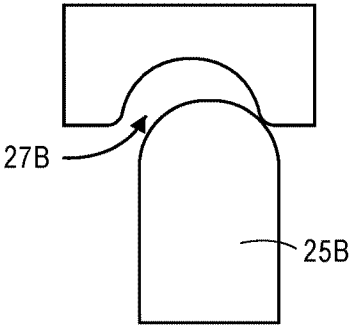
FIG. 24B shows the pin and channel geometry of FIG. 23B as the pin is releasing from the channel.
Figure 24C:
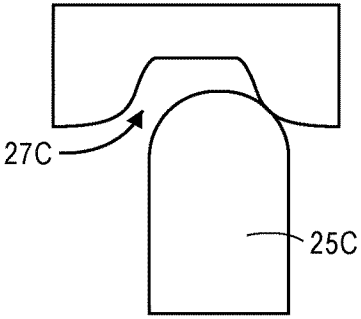
FIG. 24C shows the pin and channel geometry of FIG. 23C as the pin is releasing from the channel.

FIGS. 23*b* and 24*b* show a pin and channel geometry wherein the channel is shaped to exactly match the external pin head geometry. As shown in FIG. 24*b*, displacement of the pin decreases the surface contact between the pin and the channel, thereby decreasing the holding force as the pin is displaced.

An alternative socket geometry, referred to herein as a "vortex socket" is depicted in FIGS. 21, 22, 23*c* and 24*c*. The vortex socket results in the steepest angle of lateral contact surfaces when the pin is positioned within the socket and decreases the angle of lateral contact surfaces when/as the pin is displaced, ensuring that displacement of the pin does not increase and in some cases actually decreases, the holding force. This geometry takes advantage of the mathematical principle that at a contact angle of "0" (by which is meant a contact angle tangential to pin head), there is no resistance to lateral movement. At a contact angle of "90" there is no force that is translated down the pin. In between, there is a continuum of how much lateral force is translated into down-pin force. In the vortex socket embodiment, instead of simply mimicking the external geometry of the pin head, the walls of the socket create a socket pocket in which the pin head sits during normal operation and then sweep outwards as they extend towards the opening, away from the lateral sides of pinhead. The socket pocket acts to self-center the pin in the center of the socket during normal operation, while the outswept walls encourage release after displacement in response to a release event. This is because, as the pin is displaced, the pin moves into an increasingly more shallow portion of the socket, moving the contact point on the pin towards the distal tip, resulting in a shallower contact angle, which means that less lateral force is required to displace the pin in that direction. (Compare, for example, FIGS. 23*c* and 24*c*.)

It is noted that according to various embodiments, the sockets are entirely passive (i.e. include no moving parts) and, in fact, as depicted, the entire mount can easily be manufactured to include no moving parts. In these embodiments, any moving parts are contained within the insert. Accordingly, in embodiments wherein the mount is attached to the ski and the insert is attached to (or an integrated component of) the boot, the components attached to the ski can be small and light weight, reducing the weight of the ski, which may be significant when skis are carried. Small components on the ski also allows maximum contact surface of the boot to the ski in applications where the feet need to be close together and thus some or all of the mount lies underneath the boot, such as on a slalom water ski.

Of course while the depicted embodiments have shown only a single pin and socket tension controlled release mechanism at each end of the insert, it will be understood that any number of tension controlled release mechanisms may be used, as space and need dictate or allow. It will be understood that some embodiments of the presently described binding may be better situated for 2, 3, 4, 5, or more tension controlled release mechanisms. For example, mono-skis, sit-skis and other adaptive equipment may require a larger ski and/or greater area of contact between the equipment that is strapped (or otherwise connected) to the skier and the ski. In this case, it may be preferable to increase the number of tension controlled release mechanisms to create a suitable binding.

When multiple pins extend out of the same end of the boot or undersole, special asymmetric head geometries may be used. Most of the same considerations that relate to a single pin (per end) still apply. In addition, the individual pins may be asymmetric to the left and right of their long axis, but the pins may be approximately symmetric to each other about the YZ plane. For example, if the inward-facing surfaces are steeper than the outward-facing surfaces, then when a pin enters a socket that is not the intended or correct socket, it will both not penetrate deeply and be depressed fully flush with relatively little around Z torque. This helps to prevent a pin from sticking in an incorrect socket, either when entering the system or during a Z-rotation release.

Figure 25:
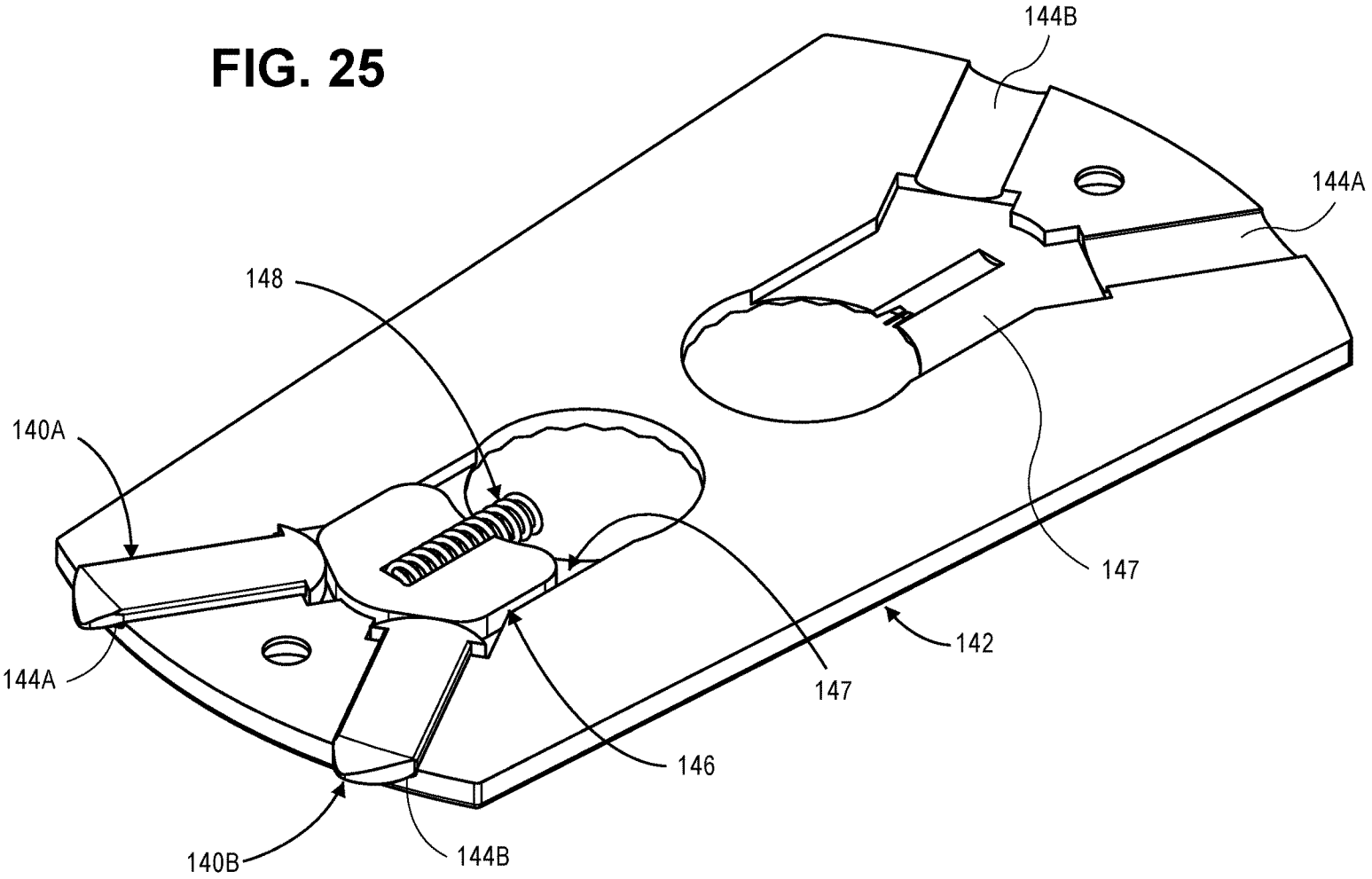
FIG. 25 is a schematic illustration of an embodiment according to present disclosure wherein multiple pins are controlled by the same tension release mechanism.

FIG. 25 provides an embodiment wherein two pins are utilized within each tension controlled release mechanism. To aid visualization, the components are only shown present on one end, while empty channels are shown at the other end. Furthermore, while some components, such as the dials, dialmates, and screws, are not shown in this illustration, their absence does not imply they could not be used. In the depicted embodiment, two pins 140*a*, 140*b*, at each end of undersole 142 are radially seated within pin channels 144*a* and 144*b*, respectively. The proximate end of each pin is operably connected to a plunger 146, which receives tension spring 148. As shown, each pin then has its own channel that intersects with a main plunger channel 147, enabling each pin to have a contact surface with the plunger. In general, the pin channel sliding axes are not parallel to one another or to the plunger channel sliding axis. In this configuration, when one pin is depressed, it depresses the plunger and tensioner. Thus, the tensioner no longer acts on the other pin(s) and therefore they can depress with very little force. This may help to allow a clean release. Note that the pin/plunger contact point may slide laterally when a pin is depressed, because the pin channel axis of sliding may not be parallel to the plunger channel axis of sliding. This same mechanism could also be used with a single pin, to allow the tensioner and the pin to point along different axes.

Of course it will be understood that the radial arrangement of the pins as depicted in FIG. 25 is not required. For example, each pin could have its own independent tension controlled release mechanism, which could be desirable for a skier who wants even finer control over the shear force required for release. However, the arrangement depicted in FIG. 25 has the advantage of allowing the skier to easily set the same tension for both pins and, perhaps more importantly, ensures simultaneous release of the pins.

It will be appreciated that some multi-pin embodiments, such as the radial arrangement described above, prevent a pin from inadvertently entering the wrong hole and misaligning the releasable undersole relative to the mount bodies. Another option to prevent inadvertent mismatching is to choose pin/socket cross-sections that do not allow a pin to enter to a non-matching socket. For example, a square pin and a round pin, with appropriate sizes, will not fit into each other's sockets. Of course it will be appreciated that many other non-matching cross-sections are possible.

Figure 27:
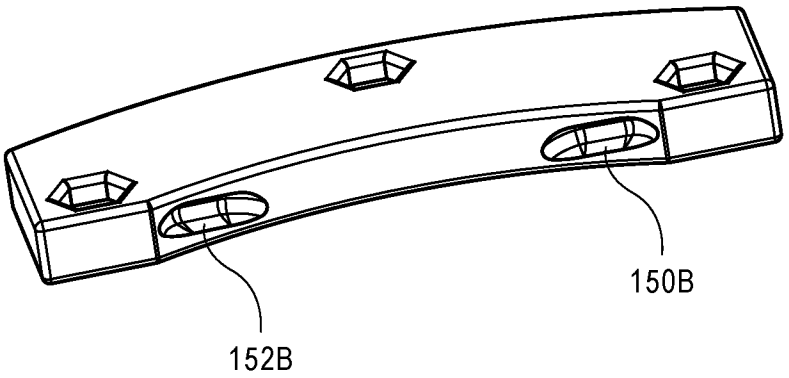
FIG. 27 is a schematic illustration of an insert having pins that are angled to match the channels in the mount body of FIG. 26.
Figure 26:
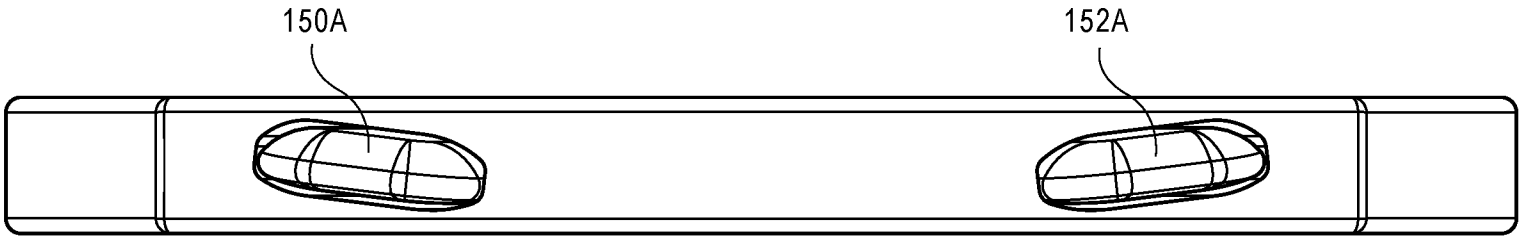
FIG. 26 is a schematic illustration of an embodiment according to the present disclosure wherein multiple channels on the same mount body are differentially angled.

A variation on the non-matching cross-sections is to mount the bodies of the pins at different out-of-plane angles. This type of pin geometry is shown in FIGS. 26 and 27 wherein pin 150*a* (FIG. 27) is positioned at a first angle and fits into similarly angled socket 150*b* (FIG. 28) and pin 152*a* (FIG. 27 is positioned at a second angle and fits into similarly angled socket 152*b*. A similar system may be used with any number of pins by selecting different angles (including 0).

It should be noted that while many of the depicted embodiments show the sliding axis of the pin to be aligned radially, this is not a requirement. Moreover, it will be understood that various combinations of any of the above geometries are also possible. As a non-limiting example, a particular binding may employ the single pin geometry shown in FIG. 13 at the heel end and the double pin geometry shown in FIG. 25 at the toe end, or vice versa.

Of course it will be understood that the direction that each pin protrudes does not need to be generally away from the foot, but can be toward the interior instead. In this case, the geometric analogy of the socket and sole may be swapped: the socket where it connects to the pin is cut from a sphere, and the sole where the pin exits is cut from a cylinder. Moreover, in an embodiment where all of the pins point inward and approximately radially, a single shared mount piece that has sockets for each of the pins could be employed. As an example, this mount piece might have a circular cross-section and be cut from a sphere, and placed near the center of the skier's foot, while the insert may comprise one or two portions cut from the sphere's surrounding cylinder, positioned to both receive and position the shared mount piece.

Note that, in practice, a thin part that is cut by a sphere is almost indistinguishable from one cut from a cylinder, because the cosine of a small angle is nearly 1.0. Therefore, various alternative embodiments could employ any combination sphere- or cylinder-derived segments or subsets thereof.

Figure 28:
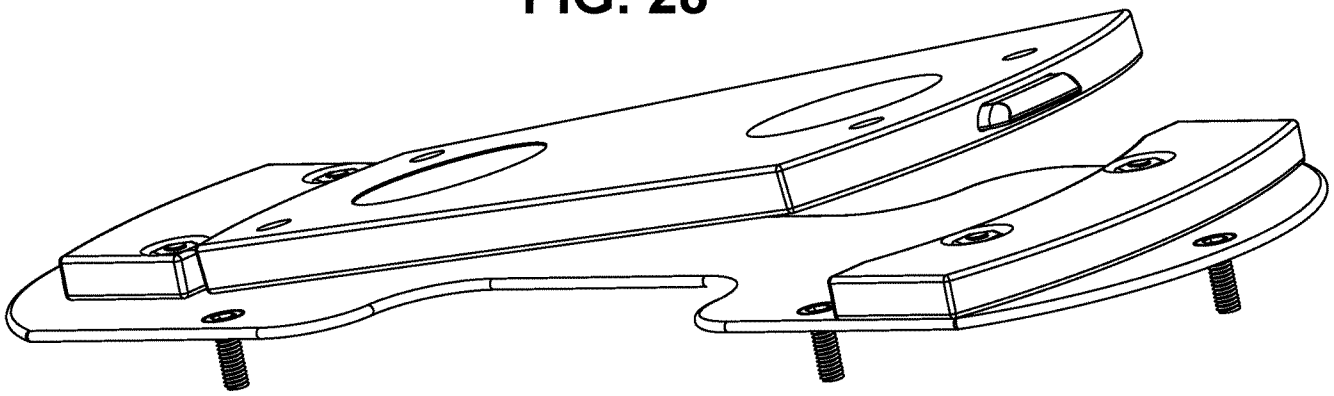
FIG. 28 is a schematic illustration of a +X rotation release in progress.
Figure 29:
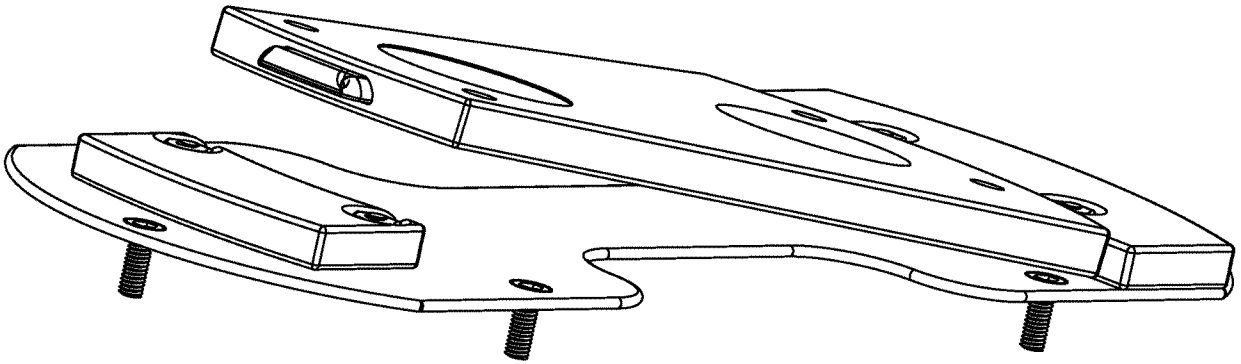
FIG. 29 is a schematic illustration of a −X rotation release in progress.
Figure 30:
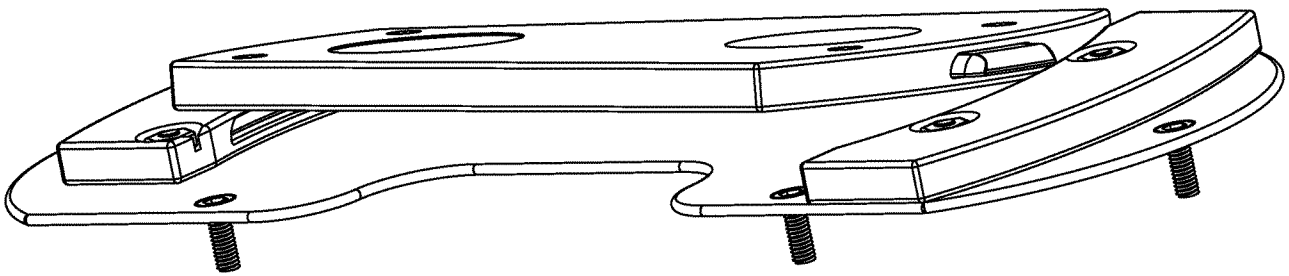
FIG. 30 is a schematic illustration of a −Y rotation release in progress.
Figure 31:
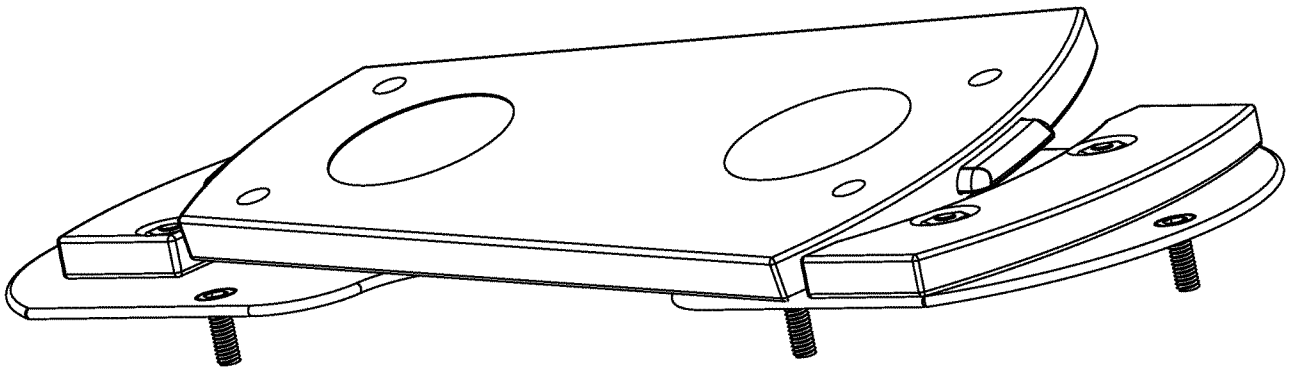
FIG. 31 is a schematic illustration of a +Y rotation release in progress.
Figures 32, 33:
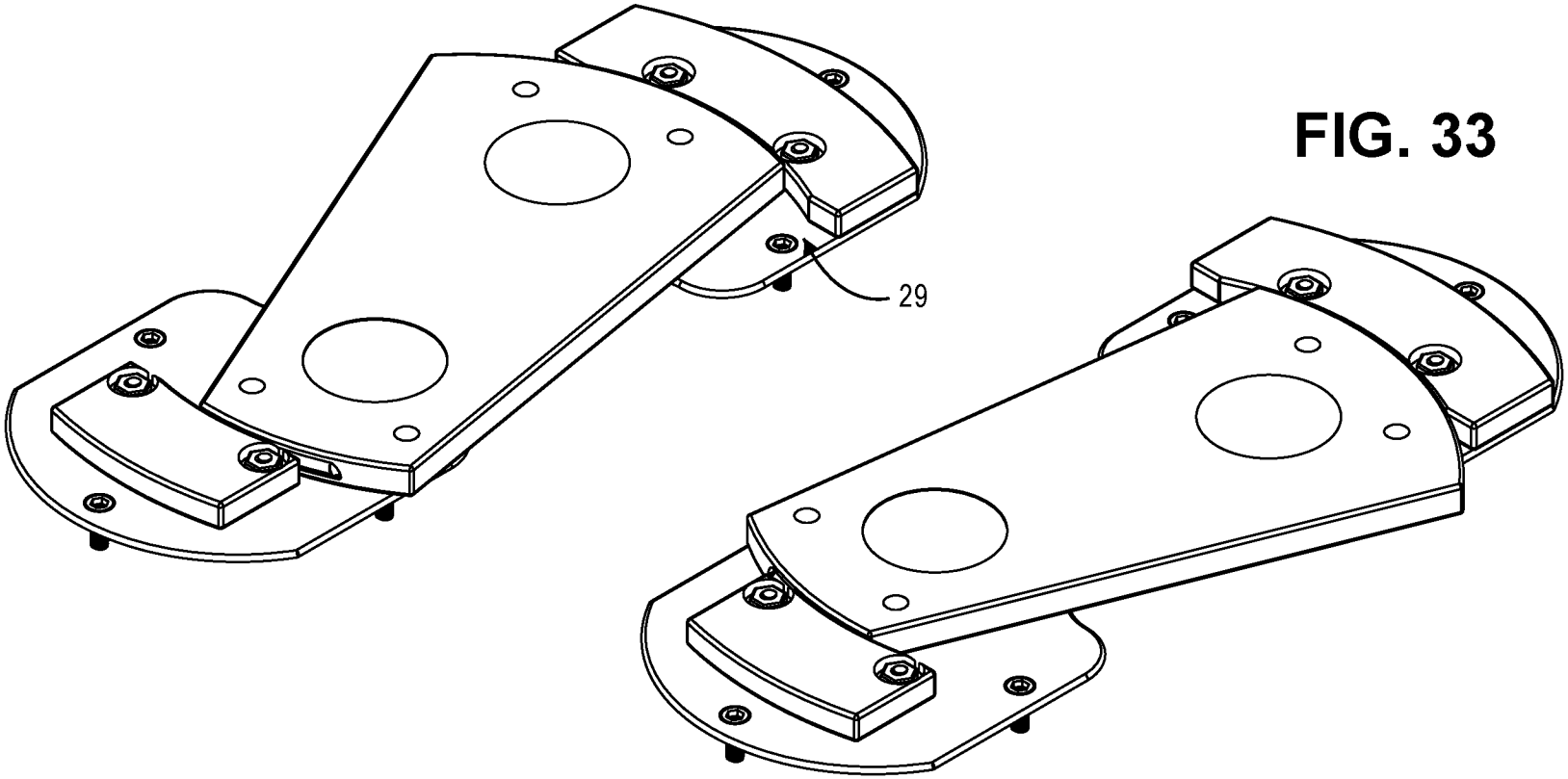
FIG. 32 is a schematic illustration of a +Z rotation release in progress.
FIG. 33 is a schematic illustration of a −Z rotation release in progress.
Figure 35:
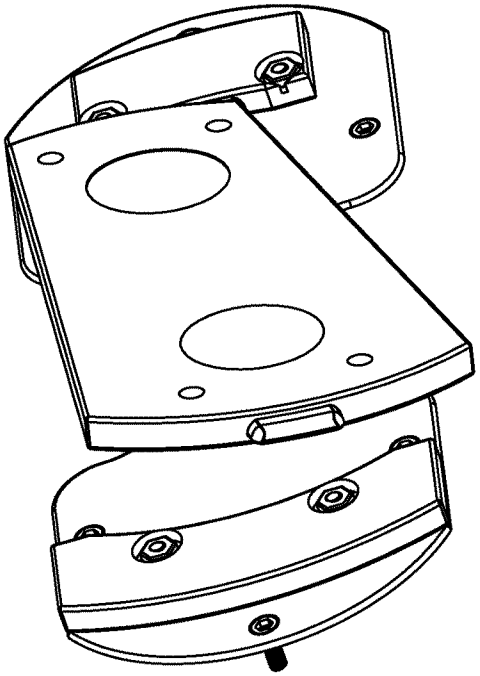
FIG. 35 is another view of the composite +X/−Y/+Z rotation release shown in FIG. 34.
Figure 34:
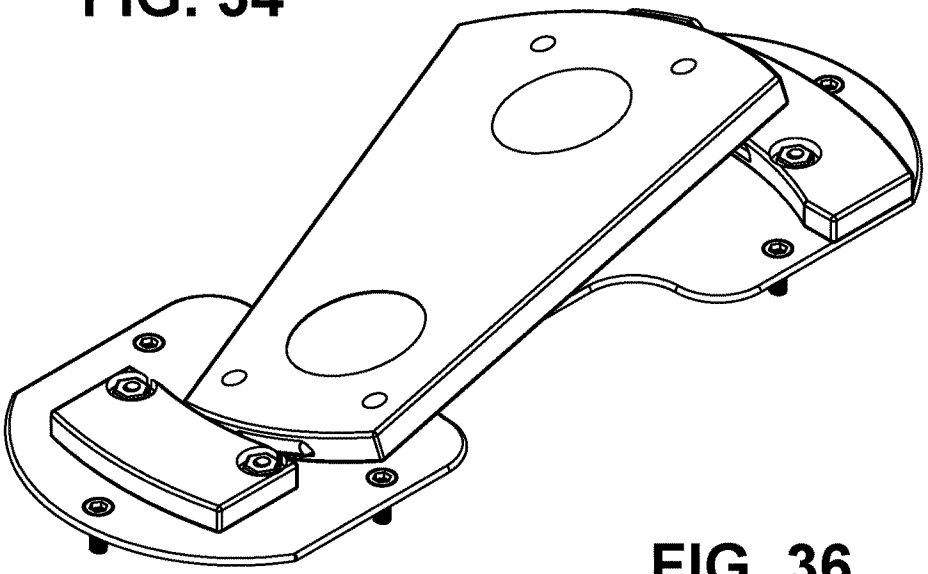
FIG. 34 is a schematic illustration of a composite +X/−Y/+Z rotation release.
Figure 36:
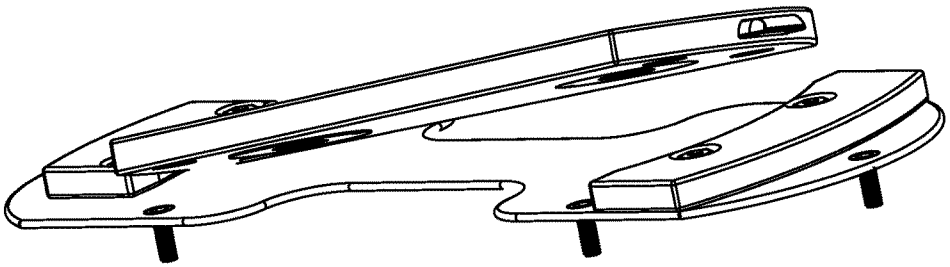
FIG. 36 is yet another view of the composite +X/−Y/+Z rotation release shown in FIG. 34.
Figure 38:
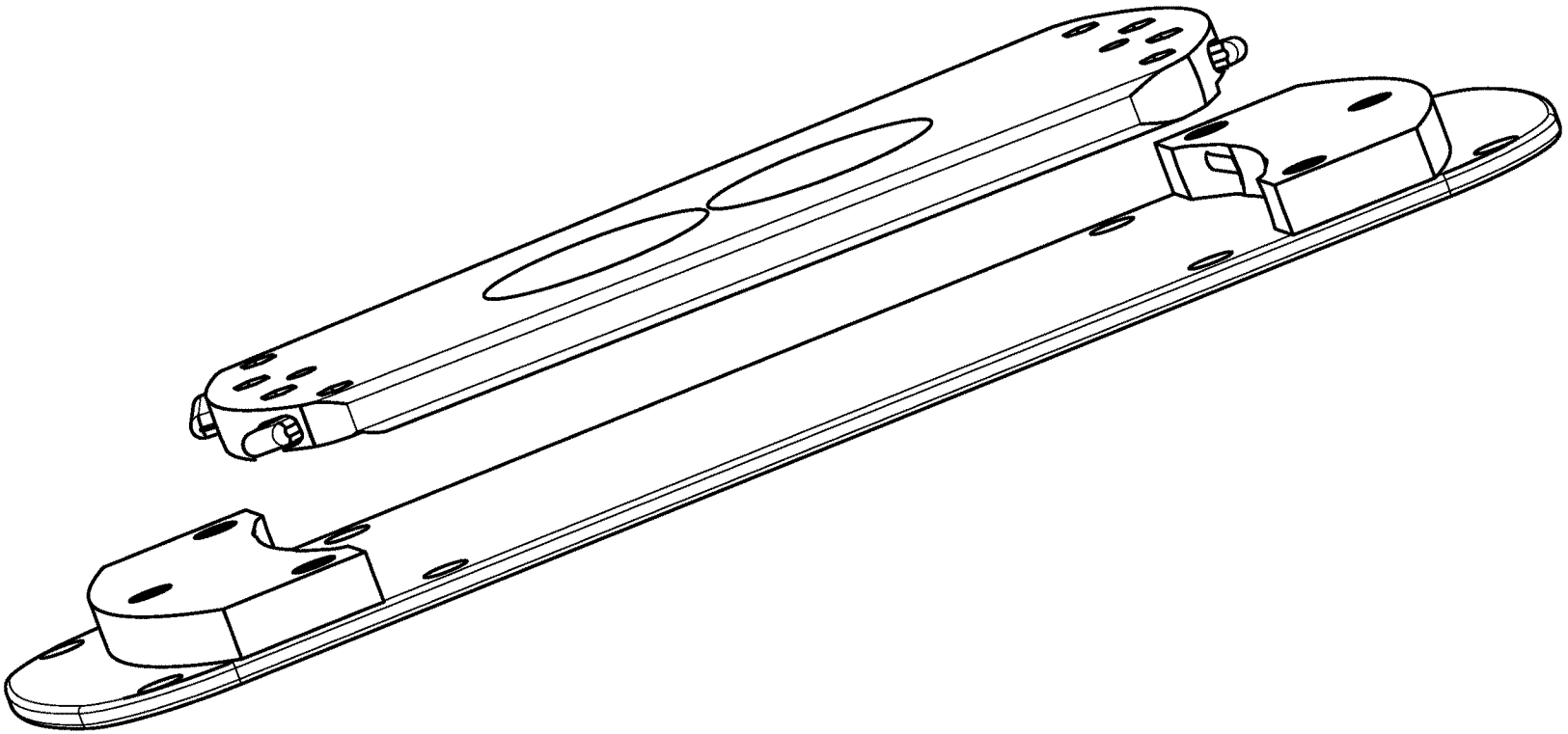
FIG. 38 is a schematic illustration of a +Z translation release.

As stated above, the sphere in cylinder geometry of the presently described binding enables infinitely incremental releases throughout an entire releasability hemisphere. These releases are demonstrated in FIGS. 28-36. FIG. 28 shows a +X rotation release in progress and FIG. 29 shows a −X rotation release in progress. FIG. 30 shows a −Y rotation release in progress while FIG. 31 shows a +Y rotation release in progress. FIGS. 32 and 33 show a +Z and −Z rotation release in progress, respectively. FIGS. 34-36 show three rotated views of a composite +X/−Y/+Z rotation release. FIG. 38 shows a +Z translation release.

It should be noted that when in the locked position, the circle in cylinder geometry has the added feature of providing a nearly seamless contact surface for the skier's boot/foot. For maximum performance and control, it is typically desirable to have as much contact as possible both between the insert and the mount and between the skier's boot and the ski. As shown, the concave curvature of each mount body (28, 30) matches the convex curvature of the toe and heel ends of the insert, so that the engagement surfaces of the mount bodies are smoothly aligned with the engagement surfaces of the insert with minimal gapping between the components. This provides the skier with a smooth, comfortable, and solid feeling footing as well as maximum control as the skier's movements are easily and directly translated to the ski.

Of course it should be realized that any angle which enables release, can also be employed in the reverse for engagement. Accordingly, the same rotations (but in the opposite direction) shown in FIGS. 28-36, and 38 can be used to "snap" the insert pins into their corresponding sockets, so long as a mechanism is provided to enable depression of the pin to make it flush with the undersole body prior to it snapping into the corresponding socket. For example, the insert can be placed flat but rotated in Z and then rotated "inwards" (i.e. in the direction opposite from the original rotation). In this case, FIGS. 32 and 33 would show the insert just prior to the pins snapping into their corresponding sockets. In this case, flat sections 29 on the mount bodies then push the pin into the insert as the insert is rotated inwards. When the pin reaches the socket, the pin pushes outwards and snaps into the socket due to force created by a tensioner, such as the front and rear tensioner springs shown in FIG. 6. The boot is then mounted on the ski via the binding. Alternatively, a shoe-horn-like approach could be employed. According to a not depicted alternative embodiment, the upper surface of the mount bodies may be ramped or incorporate a ramp that allows downwards movement of the pin against the upper surface of the mount body to depress the pin until it reaches the socket and snaps into place, enabling rotations such as those shown in FIGS. 18-31, 34-36, and 38 to secure the insert to the mount.

As a whole, FIGS. 28-36 and 38 show how the insert is designed to move relative to the mount bodies and how the unique sphere in cylinder geometry enables this movement. However, it will be understood that because the insert needs to be able to slide into place, the presence of sharp corners could hinder sliding and thus release or engagement and thus the corners could be slanted or rounded as shown in the various figures.

According to various embodiments, it may be desirable for the skier to be able to adjust the binding relative to the ski without actually redrilling holes or reattaching the mount and without changing any of the release characteristics of the binding. To accommodate this, the holes in the mount plate through which the bolts attach to ski, can be slotted in the Y direction. When the mount bolts are loose, this allows the plate to move in Y.

According to some embodiments, a subset of these slotted holes can have teeth placed on either or both sides of the slot, in any combination of embedded in or protruding out from the mount plate. In this configuration, each tooth could run along the X axis a short distance. According to this embodiment, a matching, separate bolt holder could also be provided, which also has matching teeth. The teeth may be any reasonable periodic pattern, such as triangle wave (aka saw tooth), sinusoid, or alternating half-circles. The teeth would allow a relatively fine selectin of Y position for the boot. But when the teeth are engaged and the bolt is tight, it becomes almost impossible for the mounted system to move in the Y direction. This assures the mount remains where it was intended to be.

As a further embodiment, teeth that are 180° out of phase with each other can be placed on either side of a slot. The bolt holder could also have this paired-out-of-phase pattern. This would allow the bolt to be positioned with a resolution of half the spacing of the teeth, by choosing whether to take the odd or even positions by rotating the bolt holder 180 degrees.

Alternatively or additionally, it may be desirable for the sole of the boot to be positioned on the ski rotated around the linear axis. For example, in some of the relevant disciplines, notably slalom-waterskiing, wakeboarding, and snowboarding, it is often desirable to adjust the Z-rotation (sometimes called pivot) of the mounted position of a boot. To facilitate that, the mount is rotated in the plane of the ski. Note that the axis of this rotation is not necessarily the center of the virtual sphere and cylinder of the release mechanism. Further note that this rotation has no impact on the mounting or release characteristics, because the inserts will be rotated to match when installed.

To produce a rotatable mount (i.e. one wherein the specific Z-rotation of the mounts can be selected by the skier), arced slots that all share the same axis of rotation can be used. If a mount plate is used, the holes for the mount plate can be slotted. Alternatively, whether or not a mount plate is used, the bolt holes in the mount bodies could be slotted.

In either case, teeth can be used in a manner similar to that described above, except that the teeth are in a radial pattern—i.e. the teeth all run toward the shared center. As before, the teeth may be embedded in and/or raised above the mount plate, and their radial profile may be any reasonable periodic function. Matching teeth are then cut in the bottom of each socket. Note that these socket pieces do not necessarily have identical tooth patterns to each other, due to the release center being different from the mount-rotation center.

Moreover, it should be noted that in an activity like snowboarding, where both feet are attached to the same board, this embodiment would easily enable the skier to specifically and separately adjust the specific Z-rotation angle for each foot.

Alternatively or additionally, it may be desirable for the sole of the boot to be non-coplanar with the ski. For example, it may be desired to set the boot with an X rotation (sometimes called pitch) or with a Y rotation (sometimes called cant). For small amounts of such rotations, a wedge plate placed underneath the mount plate suffices, with mount holes matching the mount plate. To allow some choice of the rotations, plates of various angles can be provided, and then stacked. For example, a 2-degree X rotation plate and a 1-degree Y rotation plate could both be placed under the mount plate. Again, this has the advantage of making no change to the release characteristics. If a larger amount of X or Y rotation is desired, then a version of the mount plate may be used that is shaped like a wedge but has holes oriented in the Z direction. Alternatively, material inside the boot can create the desired orientation of shin to ski.

Finally, while substantial attention has been paid to release of the boot from the ski due to shear force (i.e. in the event of a crash), it is understood that it may be desirable for the skier to release the boot from the ski voluntarily—for example, when a run has ended. According to a first embodiment, to voluntarily detach the skier's foot from the ski, the skier can simply loosen the boot (e.g. buckles or laces) and remove his or her foot from the boot. In this case, no actual voluntary release mechanism is integrated into the system. This is quite suitable and often employed for water sport bindings, but may not be desirable for snow sports.

Accordingly, some embodiments may include a voluntary release mechanism. An exemplary mechanism might be or include an integrated lever that forces release. For example, a longer lever outside the sole could be attached via an axis inside the sole, to a shorter lever. This creates the mechanical advantage to force the mechanism to release with a relatively small force on the external lever. Alternatively, the mechanism could include a similar lever that either pushes on the pin or de-tensions the tensioner, allowing the boot to be easily released with a slight lift.

Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A mechanism for releasably attaching an insert to an object, the mechanism comprising:

a mount affixed to the object; and an insert that tensionably and releasably secures to the mount via a tension-control mechanism, wherein:

the mount and insert have a sphere within a cylinder geometric relationship with each other such that a radial edge on the insert nests within a radial edge of the mount;

the insert releases from the mount in all incremental rotations and translations within a releasability hemisphere; and the amount of torque or force required to release the insert from the mount is operably controlled by the user via the tension-control mechanism.

2. The mechanism of claim 1 wherein the insert comprises first and second tension controlled pins and the mount comprises first and second passive sockets, wherein, when the insert is secured to the mount during normal operation, each passive socket receives and mates with one of the tension controlled pins.

3. The mechanism of claim 2 wherein, when the pin is mated with the passive socket, the mount and insert cannot move relative to each other unless a release event results in sufficient torque or force being applied to pin to achieve release of the insert from the mount.

4. The mechanism of claim 2 wherein the portion of the pin that extends into the socket has a concave curvature.

5. The mechanism of claim 3 wherein the socket is shaped such that displacement of the pin within the socket does not increase the holding force of the pin within the socket.

6. The mechanism of claim 5 wherein the socket is a vortex socket.

7. The mechanism of claim 2 wherein the first and second pins are operably connected such that the pins release simultaneously in response to a release event.

8. The mechanism of claim 1 wherein mechanical contact exists between the mount and the insert during normal operating conditions.

9. The mechanism of claim 1 wherein the insert comprises first and second distinct concave radial edge portions and the mount comprises first and second mount bodies which each have a convex radial edge portion that is complementary to the insert's concave radial edge portions.

10. The mechanism of claim 9 wherein the first and second mount bodies are shaped and positioned relative to each other so as to define a space between them and wherein at least a portion of the insert fits within the space and engages the mount body engagement surfaces on each mount body when the insert is secured to the mount.

11. The mechanism of claim 10 wherein all of the insert fits within the space when the insert is secured to the mount.

12. The mechanism of claim 9 wherein each mount body comprises first and second sockets and each radial edge portion of the insert includes two pins.

13. The mechanism of claim 12 wherein the first and second pins are operably connected such that the pins release simultaneously in response to a release event.

14. The mechanism of claim 13 wherein the first and second pins are controlled by a single spring.

15. The mechanism of claim 1 wherein the insert is attached to or integrated with a wearable object.

16. The mechanism of claim 1 wherein the wearable object is a boot.

17. The mechanism of claim 15 wherein the object is a ski.

18. A binding for attaching a piece of athletic equipment to a user, the binding comprising:

a mount attached to the athletic equipment, the mount comprising first and second mount bodies spaced part on the equipment, wherein the facing sides of the mount bodies comprise mount body engagement surfaces that are curved to define a cylindrically shaped space between the mount bodies, and wherein each mount body comprises at least one passive socket;

a insert attachable to, attached to, or integrated with a wearable article, the insert comprising:

a body shaped to resemble at least a portion of a spherical segment, the body comprising two insert engagement surfaces having a radius that matches the cylindrical geometry defined by the engagement surfaces of the first and second mount bodies;

wherein each of the insert engagement surfaces comprises a tension controlled pin shaped and positioned to engage the passive sockets when the insert is positioned in the space between the mount bodies and the mount body engagement surfaces are aligned with the insert engagement surfaces.

19. The binding of claim 18 wherein at least one of the sockets is shaped such that displacement of the pin within the socket does not increase the holding force of the pin within the socket.

20. The binding of claim 18 wherein each mount body comprises first and second sockets and each radial edge portion of the insert includes two operably connected pins and wherein the two operably connected pins release simultaneously in response to a release event.

* * * * *